US009246275B2

(12) United States Patent
Holland et al.

(10) Patent No.: US 9,246,275 B2
(45) Date of Patent: Jan. 26, 2016

(54) COAXIAL CONNECTOR WITH INGRESS REDUCTION SHIELDING

(71) Applicant: HOLLAND ELECTRONICS, LLC, Ventura, CA (US)

(72) Inventors: Michael Holland, Santa Barbara, CA (US); George Goebel, Camarillo, CA (US); Reed Gibson, Ventura, CA (US)

(73) Assignee: Holland Electronics, LLC, Ventura, CA (US)

( * ) Notice: Subject to any disclaimer, the term of this patent is extended or adjusted under 35 U.S.C. 154(b) by 0 days.

(21) Appl. No.: 14/588,889

(22) Filed: Jan. 2, 2015

(65) Prior Publication Data

US 2015/0132992 A1 May 14, 2015

Related U.S. Application Data

(63) Continuation-in-part of application No. 14/069,221, filed on Oct. 31, 2013, which is a continuation-in-part of application No. 13/712,828, filed on Dec. 12, 2012, and a continuation-in-part of application No. 14/494,488, filed on Sep. 23, 2014, now Pat. No. 9,112,323.

(60) Provisional application No. 61/620,355, filed on Apr. 4, 2012.

(51) Int. Cl.

| | |
|---|---|
| ***H01R 13/64*** | (2006.01) |
| ***H01R 13/6474*** | (2011.01) |
| ***H01R 24/44*** | (2011.01) |
| *H01R 103/00* | (2006.01) |
| *H01R 24/52* | (2011.01) |

(52) U.S. Cl.

CPC ..... *H01R 13/6474* (2013.01); *H01R 24/44* (2013.01); *H01R 24/525* (2013.01); *H01R 2103/00* (2013.01)

(58) Field of Classification Search

CPC ..... H01R 13/6474; H01R 13/6476; H01R 24/525; H01R 13/646

See application file for complete search history.

(56) References Cited

U.S. PATENT DOCUMENTS

| | | | | | |
|---|---|---|---|---|---|
| 3,757,279 | A * | 9/1973 | Winston | H01R 9/0521 | 439/584 |
| 4,275,946 | A | 6/1981 | Manina et al. | | |
| 4,633,048 | A * | 12/1986 | Komatsu | H01R 13/7033 | 200/51.1 |
| 4,660,921 | A * | 4/1987 | Hauver | H01R 13/719 | 333/22 R |
| 4,681,390 | A * | 7/1987 | Hayward | H01R 24/40 | 439/578 |
| 5,011,440 | A * | 4/1991 | Lee | H01R 4/4818 | 439/654 |
| 5,096,444 | A * | 3/1992 | Lu | H01R 24/542 | 439/578 |
| 5,150,087 | A * | 9/1992 | Yoshie | H05K 9/0066 | 333/12 |
| 5,278,525 | A * | 1/1994 | Palinkas | H03H 1/00 | 333/175 |

(Continued)

FOREIGN PATENT DOCUMENTS

| | | |
|---|---|---|
| JP | 08-168015 A | 6/1996 |
| JP | 2010-118201 A | 5/2010 |

OTHER PUBLICATIONS

Society of Cable Telecommunications Engineers; Engineering Committee Interface Practices Subcommittee; American National Standard; ANSI/SCTE 74 2011.

*Primary Examiner* — Ross Gushi

(74) *Attorney, Agent, or Firm* — Paul D. Chancellor; Ocean Law

(57) ABSTRACT

A coaxial connector with an F female end shield is configured to restrict RF ingress.

9 Claims, 28 Drawing Sheets

(56) References Cited

U.S. PATENT DOCUMENTS 5,413,502 A * 5/1995 Wang ..... H01R 24/46 439/314
5,432,488 A * 7/1995 Kotani ..... H05K 5/064 333/167
5,498,175 A * 3/1996 Yeh ..... H01R 24/542 439/276
5,625,177 A * 4/1997 Yukinori ..... G01R 1/206 200/1 R
5,632,637 A 5/1997 Diener
5,658,171 A * 8/1997 Pauza ..... H01R 13/5202 439/675
5,662,494 A * 9/1997 Zennamo, Jr. ..... H01R 13/521 439/589
5,667,409 A * 9/1997 Wong ..... H01R 9/0503 439/578
5,700,160 A * 12/1997 Lee ..... H01R 24/542 439/578
5,730,622 A * 3/1998 Olson ..... H01R 24/44 439/575
5,863,226 A * 1/1999 Lan ..... H01R 9/0503 439/578
5,865,654 A * 2/1999 Shimirak ..... H01R 13/11 439/578
5,921,793 A 7/1999 Phillips
5,980,326 A * 11/1999 Weidner ..... H01R 24/542 439/426
6,030,240 A * 2/2000 Duff ..... H01Q 1/088 200/51.1
6,065,997 A * 5/2000 Wang ..... H01R 24/542 439/578
6,071,144 A * 6/2000 Tang ..... H01R 13/52 439/426
6,113,431 A * 9/2000 Wong ..... H01R 9/0521 439/638
6,123,581 A * 9/2000 Stabile ..... H01R 24/44 439/578
6,146,168 A * 11/2000 Ishii ..... H01R 13/7031 439/188
6,146,208 A * 11/2000 Pennell ..... H01R 13/646 439/578
6,227,868 B1 * 5/2001 Wlodarski ..... H01R 24/40 439/63
6,250,960 B1 * 6/2001 Youtsey ..... H01R 9/0503 439/578
6,276,970 B1 * 8/2001 Wong ..... H01R 24/542 439/578
6,296,492 B1 * 10/2001 Fujimoto ..... H01R 13/6315 439/188
6,299,479 B1 * 10/2001 Tang ..... H01R 9/05 439/578
6,323,743 B1 * 11/2001 Zelenz ..... H01R 13/5213 333/172
6,336,820 B2 * 1/2002 Hida ..... H01R 24/42 200/51.1
6,380,826 B1 * 4/2002 Palinkas ..... H01R 24/42 333/175
6,398,568 B1 * 6/2002 Preece ..... H01R 24/46 439/188
6,439,906 B1 * 8/2002 Gray ..... H01R 24/46 439/188
6,476,688 B2 * 11/2002 Palinkas ..... H01R 24/42 333/175
6,520,785 B2 * 2/2003 Hida ..... H01R 24/46 200/51.09
6,574,855 B1 * 6/2003 Hida ..... H01R 24/46 29/592.1
6,595,799 B2 * 7/2003 Yao ..... H01R 24/44 439/578
6,636,129 B2 * 10/2003 Zennamo, Jr. ..... H03H 1/00 333/176
6,655,991 B2 * 12/2003 Heebe ..... H01R 13/633 439/348
6,659,784 B1 * 12/2003 Klein ..... H01R 24/46 200/51.1
6,674,343 B2 * 1/2004 Gould ..... H01R 13/5213 333/172
6,755,665 B2 * 6/2004 Lu ..... H01R 9/0506 439/550
6,791,436 B2 * 9/2004 Zennamo, Jr. ..... H03H 1/0007 333/167
6,794,957 B2 * 9/2004 Shafer ..... H04N 7/102 333/176
6,808,405 B1 * 10/2004 Uratani ..... H01R 13/7037 439/188
6,808,426 B2 * 10/2004 Liu ..... H01R 24/542 439/578
6,829,813 B2 * 12/2004 Zennamo ..... H01R 24/42 29/521
6,835,095 B2 * 12/2004 Chen ..... H01R 9/05 439/578
6,875,024 B2 * 4/2005 Nagano ..... H01R 13/41 439/578
6,881,082 B2 * 4/2005 Jordan ..... H01R 13/7033 439/188
6,888,423 B2 * 5/2005 Tresness ..... H01R 13/5213 333/175
6,899,563 B1 * 5/2005 Lee ..... H01R 24/40 439/578
6,955,561 B2 * 10/2005 Seymour ..... H01R 9/05 439/578
6,974,340 B2 * 12/2005 Zech ..... H01R 24/46 439/141
6,976,884 B1 * 12/2005 Lee ..... H01R 9/0521 439/546
6,986,666 B2 * 1/2006 Benson ..... H05K 9/0066 174/93
7,080,997 B2 * 7/2006 Matsuo ..... H01R 13/7031 200/51.1
7,086,867 B2 * 8/2006 Nakagawa ..... H01R 24/42 439/63
7,255,599 B1 * 8/2007 Chawgo ..... H01R 13/52 439/578
7,303,439 B1 * 12/2007 Montena ..... H01R 13/514 333/185
7,306,484 B1 * 12/2007 Mahoney ..... H01R 24/542 439/578
7,323,951 B2 * 1/2008 Montena ..... H05K 9/0066 333/175
7,354,306 B2 * 4/2008 Thorner ..... H01R 24/20 439/578
7,371,977 B1 * 5/2008 Preonas ..... H05K 9/0041 174/383
7,414,196 B2 * 8/2008 Chawgo ..... H01P 1/203 174/74 R
7,442,084 B2 * 10/2008 Montena ..... H01R 13/5202 333/185
7,527,500 B2 * 5/2009 Montena ..... H01R 13/562 439/534
7,575,474 B1 * 8/2009 Dodson ..... H01R 24/50 439/581
7,713,067 B1 * 5/2010 Behrent ..... H01R 24/50 439/63
7,731,512 B1 * 6/2010 Montena ..... H01R 4/64 439/108
7,909,614 B1 * 3/2011 Chang ..... H01R 13/41 439/581
7,972,173 B1 * 7/2011 Hyzin ..... H01R 13/2421 439/578
8,043,118 B1 * 10/2011 Lee ..... H01R 13/14 439/578
8,083,544 B2 * 12/2011 Chee ..... H01R 24/542 439/578
8,162,672 B2 * 4/2012 Huang ..... H01R 13/11 439/580
8,172,617 B2 * 5/2012 Peng ..... H01R 24/44 439/188
8,298,020 B1 * 10/2012 Chen ..... H01R 4/4818 439/852
8,454,395 B2 * 6/2013 Xu ..... H01R 13/11 439/675
8,545,235 B2 * 10/2013 Montena ..... H01R 24/42 439/63

(56) References Cited

U.S. PATENT DOCUMENTS 8,585,438 B2 * 11/2013 Tang ..... H01R 24/547 439/578
8,777,658 B2 * 7/2014 Holland ..... H01R 24/46 439/578
9,048,600 B2 * 6/2015 Holland ..... H01R 24/46
9,112,323 B2 * 8/2015 Goebel ..... H01R 24/46
9,130,288 B2 * 9/2015 Holland ..... H01R 13/17
9,136,629 B2 * 9/2015 Holland ..... H01R 13/17
2003/0129873 A1 * 7/2003 Heebe ..... H01R 13/633 439/578
2003/0181073 A1 * 9/2003 Nagano ..... H01R 13/41 439/63
2004/0198094 A1 * 10/2004 Seymour ..... H01R 9/05 439/578
2005/0001697 A1 * 1/2005 Gould ..... H01R 13/5213 333/185
2005/0148236 A1 7/2005 Montena
2005/0162238 A1 * 7/2005 Ho ..... H01R 24/42 333/185
2005/0164525 A1 * 7/2005 Benson ..... H05K 9/0066 439/63
2005/0245104 A1 * 11/2005 Nakagawa ..... H01R 24/42 439/63
2006/0246774 A1 * 11/2006 Buck ..... H01R 9/0521 439/578
2007/0298653 A1 * 12/2007 Mahoney ..... H01R 24/542 439/578
2009/0011628 A1 1/2009 Purchon
2009/0114424 A1 5/2009 Holland
2009/0181575 A1 * 7/2009 Hung ..... H01R 9/0521 439/583
2010/0093211 A1 * 4/2010 Sutter ..... H01R 9/0521 439/578
2010/0255721 A1 10/2010 Purdy et al.
2011/0045694 A1 * 2/2011 Chee ..... H01R 24/542 439/578
2011/0076885 A1 * 3/2011 Shaw ..... H01R 13/111 439/582
2011/0117776 A1 5/2011 Burris et al.
2011/0244720 A1 * 10/2011 Peng ..... H01R 24/44 439/578
2012/0040555 A1 * 2/2012 Shih ..... H01R 13/502 439/578
2013/0040481 A1 * 2/2013 Vallely ..... H01R 13/111 439/312
2013/0115809 A1 * 5/2013 Hanson ..... H01R 4/10 439/578
2013/0244481 A1 * 9/2013 Holland ..... H01R 24/46 439/578
2013/0244483 A1 * 9/2013 Montena ..... H01R 9/0524 439/578
2013/0244509 A1 * 9/2013 Holland ..... H01R 24/46 439/840
2013/0252462 A1 * 9/2013 Tang ..... H01R 24/547 439/578
2013/0266275 A1 * 10/2013 Holland ..... H01R 24/44 385/90
2013/0316578 A1 * 11/2013 Takahashi ..... H01R 4/185 439/585
2014/0162494 A1 * 6/2014 Holland ..... H01R 13/658 439/578
2014/0315428 A1 * 10/2014 Holland ..... H01R 24/46 439/578
2015/0038009 A1 * 2/2015 Gibson ..... H01R 13/6581 439/578
2015/0132992 A1 * 5/2015 Holland ..... H01R 24/44 439/578
2015/0263463 A1 * 9/2015 Holland ..... H01R 24/46 439/578

* cited by examiner

1100B

1200B

1200C

1300B

1300C

1700B

| Item | Measure (mm) | |
|---|---|---|
| | RG59 | RG6 |
| CCOD | 0.81 | 1.02 |
| WID | 2.0-3.0 | 2.0-3.0 |
| IID | 1.4-2.4 | 1.4-2.4 |
| WOD | 6.8 | 6.8 |
| WT | 0.3-0.9 | 0.3-0.9 |
| RC | 0.40-1.40 | 0.19-1.19 |

COAXIAL CONNECTOR WITH INGRESS REDUCTION SHIELDING

PRIORITY CLAIM AND INCORPORATION BY REFERENCE

This application is 1) a continuation-in-part of U.S. patent application Ser. No. 14/069,221 filed Oct. 31, 2013 which is a continuation-in-part of U.S. patent application Ser. No. 13/712,828 filed Dec. 12, 2012, which claims the benefit of U.S. Prov. Pat. App. No. 61/620,355 filed Apr. 4, 2012 and 2) a continuation in part of U.S. patent application Ser. No. 14/494,488 filed Sep. 23, 2014. All of the aforementioned patent applications are incorporated by reference herein, in their entireties and for all purposes.

BACKGROUND OF THE INVENTION

1. Field of the Invention

The present invention relates to an article of manufacture for conducting electrical signals. In particular, F-Type connectors are equipped to reject RF ingress.

2. Discussion of the Related Art

FIGS. 1, 2, 3A-C, and 4 show prior art F-Type connectors. FIG. 1 shows a perspective view 100 of a prior art F female port 102 mounted to a wall plate 104. FIG. 2 shows a side view 200 of FIG. 1 revealing a coaxial cable 208 attached via an F male connector 206 to the F female port and leaving a room facing attachment end 204 of the F female port exposed to stray signals and/or RF ingress 210.

FIGS. 3A-C show a cross-sectional view 300A, side view 300B and a perspective view 300C of a prior art F splice with female ports 332, 334 at opposed ends. This splice provides interconnected internal contacts 312, 314 for engaging respective coaxial cable center conductors and a body 316 for engaging F male connector couplings such as threaded nuts and having electrical continuity with respective coaxial cable outer conductors. The splice body 316, such as a metallic body, provides for transport of a coaxial cable ground signal.

Threads 322, 324 at opposing ends of the splice tubular body 316 provide a means for engaging F male connector couplings at the splice end ports. The splice assembly end ports 332, 334 typically include an inwardly directed shallow metal lip 342 that may be rolled from the body or provided in another fashion, for example by fixing a shallow ring at the tube end. The lip provides peripheral support to a disc shaped end insulator 344 within the splice body. An insulator central aperture 346 is for receiving a center conductor of a coaxial cable. Behind this insulator is the internal contact 312 (314) mentioned above.

FIG. 4 shows a cross-sectional view of a bulkhead port 400. To the extent that connector internals are insertable from only a single end, the connector may be referred to as "blind." The port has an F female port 432 at one end and a mount 450 at an opposed end. Similar to the splice above, the port includes an electrically conductive body 416, an internal contact 412 behind an insulator 444 held in place by a port end lip 442. An aperture 441 in the insulator provides for inserting a coaxial cable center conductor into the port contact 412 and body threads 422 provide for engaging an F male connector coupling such as a threaded nut.

Unlike the splice 300A-C, the bulkhead port 400 has a mount 450 at one end that may be separate from or include portions of a device/equipment bulkhead or portion(s) thereof. The mount supports the bulkhead port from a base 452. A contact 412 trailing portion 481 passes through a hole in a base insulator 456 and then through a hole 458 in the base.

As may be required, the base is insulated from the contact by an air gap or by another means known to skilled artisans.

These prior art connectors may become the source of future problems as proliferation of RF devices such as cellular telephones crowd RF spectra and increase the chances RF ingress will adversely affect interconnected systems such as cable television and satellite television signal distribution systems.

Persons of ordinary skill in the art have recognized that in cable television and satellite television systems ("CATV"), reduction of interfering radio frequency ("RF") signals improves signal to noise ratio and helps to avoid saturated reverse amplifiers and related optic transmission that is a source of distortion.

Past efforts have limited some sources of the ingress of interfering RF signals into CATV systems. These efforts have included increased use of traditional connector shielding, multi-braid coaxial cables, connection tightening guidelines, increased use of traditional splitter case shielding, and high pass filters to limit low frequency spectrum interfering signal ingress in active home CATV systems.

The F connector is the standard connection used for cable television and satellite signals in the home. For example, in the home one will typically find a wall mounted female F connector or a coaxial cable "drop" splitter or isolator for supplying a signal to the TV set, cable set-top box, or internet modem.

A significant location of unwanted RF signal and noise ingress into CATV systems is in the home. This occurs where the subscriber leaves a CATV connection such as a wall-mounted connector or coaxial cable drop connector disconnected/open. An open connector end exposes a normally metallically enclosed and shielded signal conductor and can be a major source of unwanted RF ingress.

As shown above, a CATV signal is typically supplied to a room via a wall mounted connector or in cases a simple "cable drop." These and similar cable interconnection points provide potential sources of unwanted RF signal ingress into the CATV system. As will be appreciated, multiple CATV connections in a home increase the likelihood that some connections will be left unused and open, making them a source of unwanted RF ingress. And, when subscribers move out of a home, CATV connections are typically left open, another situation that invites RF ingress in a CATV distribution system.

Known methods of eliminating unwanted RF ingress in a CATV system include placing a metal cap over each unused F connector in the home or, placing a single metallic cap over the feeder F port at the home network box. But, the usual case is that all home CATV connections are left active, and when unused, open, a practice the cable television operators and the industry have accepted in lieu of making costly service calls associated with new tenants and/or providing the CATV signal in additional rooms.

The inventor's work in this area suggests current solutions for reducing unwanted RF ingress resulting from open connectors are not successful and/or not widely used. Therefore, to the extent the CATV industry comes to recognize a need to further limit interfering RF ingress into CATV systems, it is desirable to have connectors that reduce RF ingress when they are left open.

Prior art exists which attempts to accomplish this goal but is generally thought to be prohibitively expensive, impractical, or mechanically unreliable. For example, one prior art method disclosed in patent applications of the present inventor disconnects the center conductor contact when the F female is not connected to a male connector. Another method is disclosed in U.S. Pat. No. 8,098,113 where an electronic method differentially cancels noise common to both the center conductor and shield and requires an electric power source. These methods are relatively expensive compared with at least some embodiments of the present invention. They also have reliability limitations due to either of included mechanical or electrical elements.

Presently, it appears the industry has little interest in RF ingress reduction solutions similar to those proposed herein. However, in the inventor's view, there are good reasons to pursue the invention herein to maintain signal quality.

SUMMARY OF THE INVENTION

The present invention provides a shield against unwanted radio frequency ("RF") signal transfer in coaxial cable installations. Shielding devices of the present invention include electromagnetic radiation shields such as waveguides and particularly dimensioned waveguides adapted to function in conjunction with coaxial cable connectors.

Electromagnetic shields include devices causing electric charges within a metallic shield to redistribute and thereby cancel the field's effects in a protected device interior. For example, an interior space can be shielded from certain external electromagnetic radiation when effective materials(s) and shield geometry(ies) are used.

Applications include cavity openings that are to be shielded from ingress, or in some cases, egress, of certain RF signals or noise with an appropriate shield located at the opening. Effective shields include perforated structures such as plates, discs, screens, fabrics, perforated plates, and perforated discs. In effect, these shields are waveguide(s) tending to attenuate and/or reject passage of certain frequencies.

In the context of a coaxial cable connector, connector internal conductors or portions thereof may act as antennas to receive unwanted RF signals and/or noise via connector openings.

Coaxial cable connectors can be shielded from unwanted RF ingress even when a coaxial cable connector end is left open, for example when an F female port or connector end is left open. In various embodiments, unwanted RF ingress is restricted in a coaxial connector by, inter alia, appropriately selecting waveguide geometry including in some embodiments the size of a waveguide central aperture.

In various embodiments, coaxial cable connector waveguides are electrical conductors such as plates and fabrics. Plates include discs and in particular generally circular discs. Fabrics include meshes and weaves. Exemplary RF screens are made from a conducting material and have opening size(s) and thickness(es) that are effective to preferentially block RF ingress such as RF ingress in a particular frequency band. Suitable waveguide materials generally include conductors and non-conductors intermingled, commixed, coated, and/or impregnated with conductors.

Incorporated by reference herein in its entirety and for all purposes are the exemplary shield technologies described in U.S. Pat. No. 7,371,977 to inventor Preonas, including in particular the shields of FIGS. 2 and 3 and shield design considerations of FIG. 4. As skilled artisans will recognize, analytical shield and waveguide design methods are generally available and include code incorporating Faraday's Law and finite element modeling techniques. Use of these well-known tools by skilled artisans will typically provide good approximations of shield design variables for particular specifications including waveguide aperture size, thickness, and choice of material.

Inventor experiments on some prototype waveguide designs generally showed a) increasing waveguide thickness tended to reduces return loss at 75 Ohms impdance.

Embodiments of the present invention provide solutions to problematic RF ingress into CATV distribution systems via inadequately shielded and/or open ended coaxial cable connectors subject to unwanted RF transfer. Embodiments of the invention limit unwanted RF signal transfer into media and media distribution systems such as CATV distribution systems.

As will be appreciated, embodiments of the invention disclosed herein have application to additional frequency bands and signal types. In various embodiments, providing waveguides made using effective material(s), hole size(s), and thickness(s) enables wide adaptation for mitigating unwanted signal ingress in selected frequency bands.

Various embodiments of the invention provide for waveguides with a generally annular structure and incorporating RF shielding material for shielding against undesired ingressing, or, in cases, egressing signals at frequencies in ranges below 100 MHz and at frequencies reaching 2150 MHz. Waveguide aperture shapes may be circular or other such as polygonal, curved, multiple curved, and the like. Aperture sizes include those with opening areas equivalent to circular diameters of 1.5 to 3 mm and aperture thicknesses include thicknesses in the range 0.5 to 2.0 mm. In some implementations, connectors with waveguides utilize apertures that are integral with a connector body or a disc/barrier that is within a portion of the connector such as a disk/barrier placed inside a connector body entry but before a connector coaxial cable center conductor contact. Suitable waveguide materials and structures include those known to skilled artisans such as metal waveguides and waveguides that incorporate surface and/or internal shielding materials including those described below.

An embodiment of the invention provides an aperture 2 to 3.5 mm with a nominal thickness between 0.5 to 1.5 mm. This combination of hole size and thickness acts as a waveguide to restrict ingress of low frequencies, typically under 100 Mhz by 20-40 dB (in some cases 1/100 of the signal) of that of an open-ended F port (See FIG. 9).

The combination of sizes serves to restrict the low frequency ingress while only minimally reducing the impedance of the operational connector interface. The reduced impedance match (sometimes characterized in terms of return loss) of the invention remains within limits acceptable to the CATV industry. As the aperture size grows beyond 3.5 mm, there is typically less shielding against unwanted signals at the connector entry.

A purpose of some embodiments of the invention is to maximize the RF shielding or ingress at low frequency while providing a good impedance match of the connector interface during operation. The inventor found that the thickness of the end surface or shield disc can also be an important factor in some embodiments. For example, thicknesses in the range of 0.5 to 1.5 mm were found to be effective in blocking frequencies under 100 Mhz.

An embodiment of the invention uses a 2 mm aperture or end hole size. And, some embodiments use tuned slots in addition to the 2 to 3.5 mm aperture. These slots or waveguide bars may be added to the port end surface or to an internal shield disc for specific frequency restriction.

An embodiment of the invention uses a shield disc from a polymer or ceramic material that can be coated or impregnated with a magnetic material active at specific frequencies. In addition to being homogeneously mixed with the ceramic or polymer, the material can be deposited or sputtered on the shield disc surface in different thicknesses or patterns to better affect specific frequencies. The shield may be a combination of waveguide and sputters or deposited material to more economically produce the shield. Discs made of two or more materials can be described as hybrid discs.

In various embodiments, the invention comprises: an outer connector body; a female end of the connector is for engaging a male coaxial cable connector; the connector female end having a waveguide with an aperture for receiving a center conductor of a coaxial cable; wherein the diameter of the aperture is in the range 1.3 mm to 3.0 mm; and, wherein the waveguide is configured to shield connector body internals from ingress of radio frequency signals in the range of 10 to 100 megahertz.

And, in some embodiments, the connector further comprises: a waveguide surface; the waveguide surface bordering the aperture and an aperture centerline about perpendicular to the waveguide surface; the thickness of a waveguide surface measured along a line parallel to the aperture centerline is not less than 0.5 mm; and, the thickness of the waveguide surface measured along a line parallel to the aperture centerline is not more than 1.5 mm.

And, in some embodiments, the connector further comprises: wherein the diameter of the aperture and the thickness of the waveguide are selected in a manner consistent with achieving a connector impedance of 75 ohms. And, in some embodiments, the connector further comprises: a rim of the outer connector body; and, the waveguide formed by the rim. And, in some embodiments the connector alternatively comprises: a rim of the outer connector body; and, the waveguide formed by a disc held in place by the rim.

And, in various embodiments, the invention comprises: an outer connector body; a female end of the connector is for engaging a male coaxial cable connector; the connector female end having a waveguide with an aperture for receiving a center conductor of a coaxial cable; the diameter of the aperture is not less than two times the diameter of the center conductor; the diameter of the aperture is not more than 4 times the diameter of the center conductor; and, wherein the waveguide is configured to shield connector body internals from ingress of radio frequency signals in the range of 10 to 100 megahertz while maintaining a nominal connector impedance of 75 ohms.

And, in some embodiments, the connector further comprises: a waveguide surface; the waveguide surface bordering the aperture and an aperture centerline about perpendicular to the waveguide surface; the thickness of a waveguide surface measured along a line parallel to the aperture centerline is not less than 0.5 mm; and, the thickness of the waveguide surface measured along a line parallel to the aperture centerline is not more than 1.5 mm.

And, in some embodiments, the connector further comprises: wherein the diameter of the aperture and the thickness of the waveguide are selected in a manner consistent with achieving a connector impedance of 75 ohms. And, in some embodiments, the connector further comprises: a rim of the outer connector body; and, the waveguide formed by the rim. And, in some embodiments, the connector alternatively comprises: a rim of the outer connector body; and, the waveguide formed by a disc held in place by the rim.

Yet other embodiments of the invention comprise a female F connector with an end opening body hole or separate entry disc behind the hole opening from 1.5 to 3 mm port with a thickness of 0.5 to 1.5 mm. In some embodiments, the disc is made from a metallic material and in some embodiments the disc is made from a metallically impregnated polymer or ceramic material. Some embodiments of the disc are made with additional waveguide slots and some embodiments of the disc are made including one or more of a polymer, ceramic, or fiberglass material for example with a sputtered or etched magnetic material on the surface.

As will be appreciated, embodiments of the invention disclosed herein have application to additional frequency bands and signal types. In various embodiments, providing waveguides made using effective material(s), hole size(s), and thickness(s) enables wide adaptation for mitigating unwanted signal ingress in selected frequency bands.

An embodiment of the invention provides an aperture 2 to 3.5 mm with a nominal thickness between 0.5 to 1.5 mm. This combination of hole size and thickness acts as a waveguide to restrict ingress of low frequencies, typically under 100 Mhz by 20-40 dB (in some cases 1/100 of the signal) of that of an open-ended F port (See FIG. 9).

The combination of sizes serves to restrict the low frequency ingress while only minimally reducing the impedance of the operational connector interface. The reduced impedance match (sometimes characterized in terms of return loss) of the invention remains within limits acceptable to the CATV industry. As the aperture size grows beyond 3.5 mm, there is typically less shielding against unwanted signals at the connector entry.

A purpose of some embodiments of the invention is to maximize the RF shielding or ingress at low frequency while providing a good impedance match of the connector interface during operation. The inventor found that the thickness of the end surface or shield disc can also be an important factor in some embodiments. For example, thicknesses in the range of 0.5 to 1.5 mm were found to be effective in blocking frequencies under 100 Mhz.

An embodiment of the invention uses a 2 mm aperture or end hole size. And, some embodiments use tuned slots in addition to the 2 to 3.5 mm aperture. These slots or waveguide bars may be added to the port end surface or to an internal shield disc for specific frequency restriction.

An embodiment of the invention uses a shield disc from a polymer or ceramic material that can be coated or impregnated with a magnetic material active at specific frequencies. In addition to being homogeneously mixed with the ceramic or polymer, the material can be deposited or sputtered on the shield disc surface in different thicknesses or patterns to better affect specific frequencies. The shield may be a combination of waveguide and sputters or deposited material to more economically produce the shield.

BRIEF DESCRIPTION OF THE DRAWINGS

The present invention is described with reference to the accompanying figures. These figures, incorporated herein and forming part of the specification, illustrate embodiments of the invention and, together with the description, further serve to explain its principles enabling a person skilled in the relevant art to make and use the invention.

DESCRIPTION OF THE PREFERRED EMBODIMENTS

Figure 1:
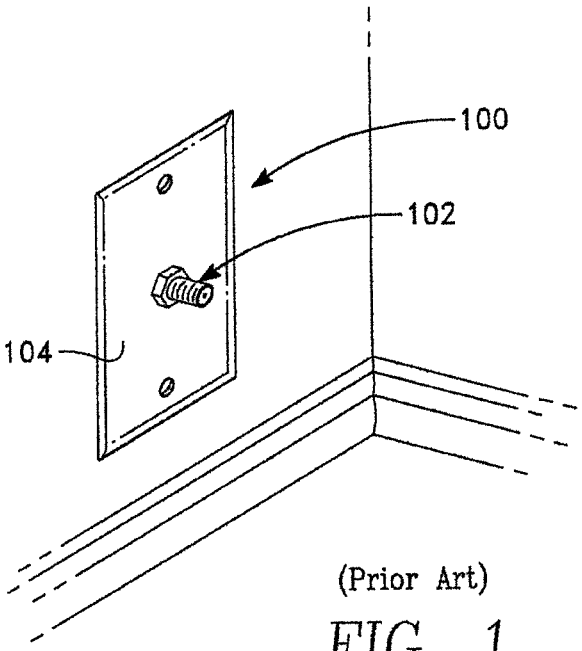
(Prior Art) FIG. 1
FIG. 1 shows a perspective view of a prior art F port and splice.
Figure 2:
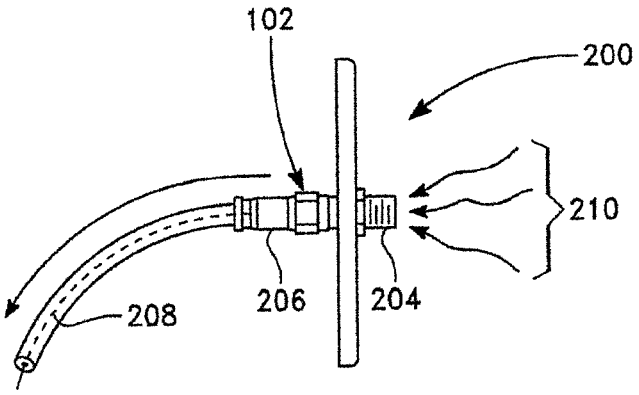
(Prior Art) FIG. 2
FIG. 2 shows a side view of FIG. 1.
Figure 3A:
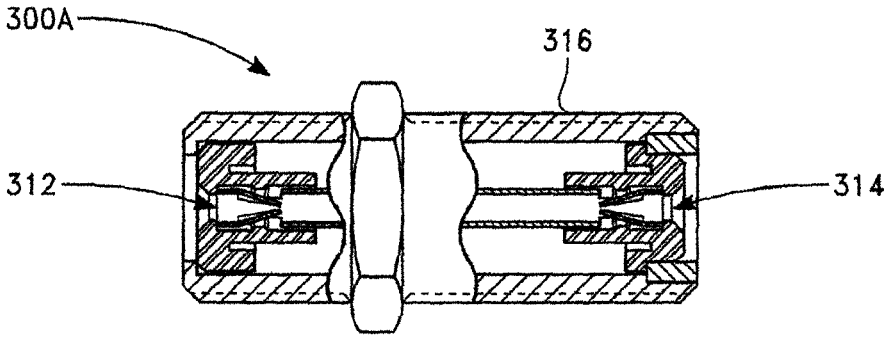
(Prior Art) FIG. 3A
FIGS. 3A-C show prior art F splice views.
Figure 3B:
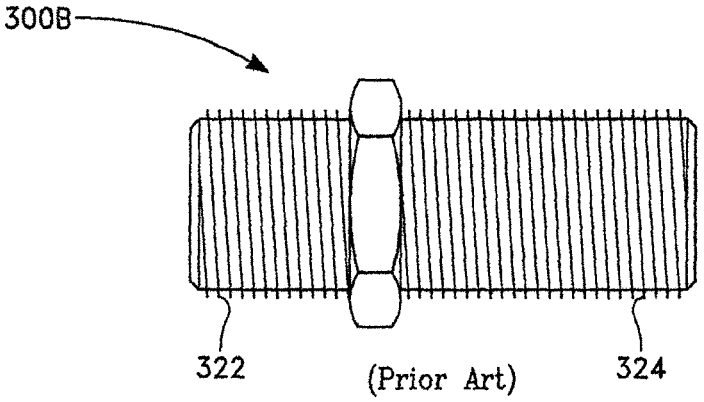
(Prior Art) FIG. 3B
Figure 3C:
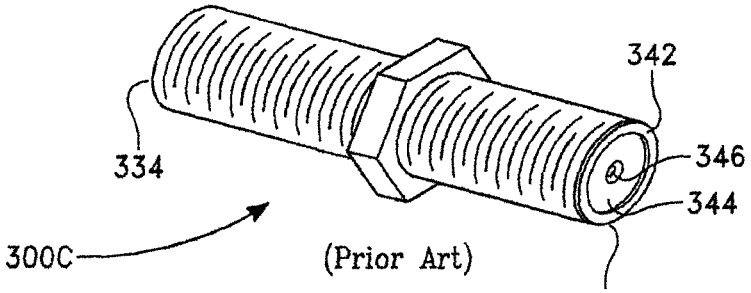
(Prior Art) FIG. 3C
Figure 4:
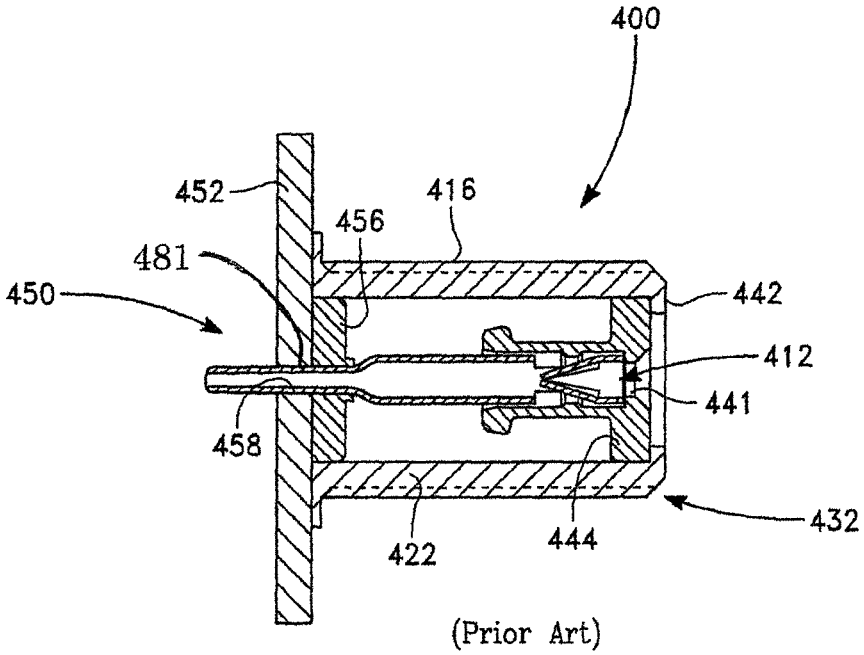
(Prior Art) FIG. 4
FIG. 4 shows a prior art bulkhead type F port.

The disclosure provided herein describes examples of some embodiments of the invention. The designs, figures, and descriptions are non-limiting examples of the embodiments they disclose. For example, other embodiments of the disclosed device and/or method may or may not include the features described herein. Moreover, disclosed advantages and benefits may apply to only certain embodiments of the invention and should not be used to limit the disclosed invention.

Embodiments of the invention provide a method of reducing RF cable interconnection ingress. In various embodiments, cable interconnection RF ingress is reduced by including a filter such as a waveguide and/or a screen at the cable entry end of an F-Type female port. Examples include filters that are frequency and/or frequency range specific.

Restriction of the ingress of RF frequencies may be for particular applications such as restricting frequencies below 100 MHz for CATV applications and specific frequencies for satellite and home networking. Because ingress restriction devices may change an F connector's characteristic impedance, for example 75 Ohm devices, filter geometry may be varied to balance filter performance and maintenance of a desired characteristic impedance within an acceptable range.

Notably, typical F female port geometry includes entry hole sizes that range from 4.0-5.5 mm as compared with the F connector tube or body overall diameter of 9.7 mm (⅜-32 outer thread). CATV industry standards promulgated by the Society of Cable Television Engineers ("SCTE") show a minimum port opening of 4.3 mm to insure desired connector impedance when, for example, they cannot control the corresponding annular end wall thickness. By selecting filter performance related dimensions and materials, embodiments of the present invention reduce stray signal ingress while maintaining particular return loss performance consistent with SCTE and/or industry standards. In an embodiment, a minimum return loss is 20 dB.

Applicant notes that in telecommunications, return loss is the loss of signal power resulting from the reflection caused by a discontinuity in a transmission line. This discontinuity can be a mismatch with the terminating load or with a device inserted in the line.

$$RL(\text{dB}) = 10\log_{10}\frac{P_i}{P_r}$$

Return loss is usually expressed in decibels dB where RL(dB) is the return loss in dB, $P_i$ is the incident power and $P_r$ is the reflected power. Return loss is related to both standing wave ratio (SWR) and reflection coefficient (Γ). Increasing return loss corresponds to lower SWR. Return loss is a measure of how well devices or lines are matched. A match is good if the return loss is high. A high return loss is desirable and results in a lower insertion loss.

In some embodiments, the invention provides a waveguide in the form of a waveguide "washer," that is an electrically conductive disc with a central hole. In an embodiment, a waveguide aperture or entry hole diameter is in the range of 2.0-2.5 mm and the waveguide thickness in the range of 0.5-1.5 mm. This particular combination of waveguide hole size and thickness provides a device for restricting ingress of frequencies typically below 100 MHz with significant attenuation. As used herein, the term disc includes structures such as a separator, a plate, a flat plate, a circular plate, a perforated plate, a disc, and a disk, any of which may be made from one or more of plates, fabrics, composites, and the like.

Embodiments provide RF ingress attenuation in the range of 20-40 dB (reductions to 1/100 of the signal) when compared with RF ingress of an open-ended F female port without the waveguide or other RF ingress protection. Persons of ordinary skill in the art will recognize waveguide dimensions may be varied within and around the ranges to provide particular waveguide and connector performance.

Dimensions of waveguide aperture and thickness may be chosen to restrict RF ingress such as low frequency ingress managing the impedance of the operational connector interface. Embodiments of the invention perform with return losses acceptable in the CATV and satellite television industry. For example, where the waveguide aperture size is greater than 3 mm, RF ingress continues to be restricted to some degree but there is less shielding of the connector entry.

Embodiments of the invention may enhance RF shielding for ingress at low frequencies while providing a good impedance match of the connector interface while in operation. For example, various embodiments control the thickness of the end surface or shield disc to enhance performance. Waveguide thicknesses in the range of 0.5 to 1.5 mm have demonstrated an ability to block frequencies below 100 MHz.

Figure 5:
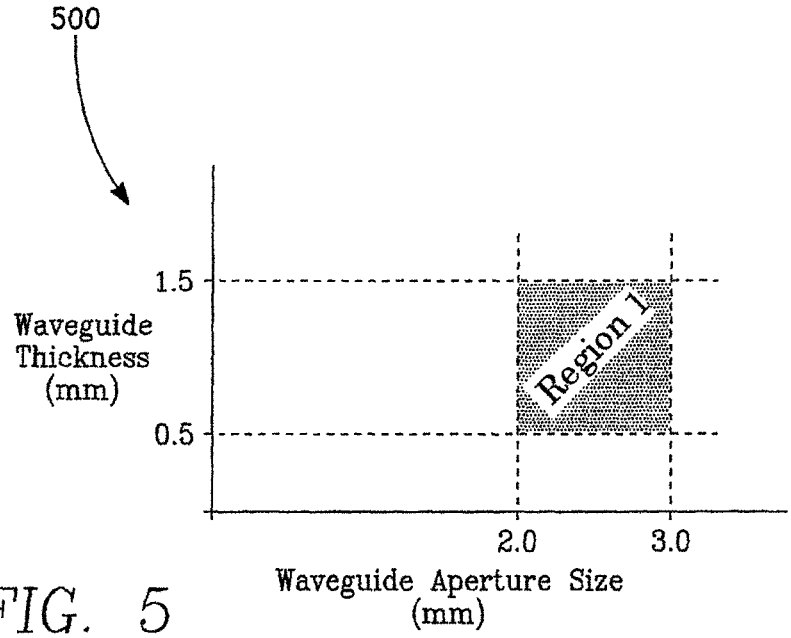
FIG. 5 shows a first chart of waveguide dimensions for some embodiments of the present invention.

FIG. 5 shows an exemplary chart of waveguide thickness and waveguide aperture size 500. In particular, the chart shows ranges of aperture size and thickness within a particular region, Region 1, that has been shown to yield desirable RF ingress attenuation in CATV applications.

FIG. 5 illustrates thickness and aperture size ranges tested in connection with rejecting unwanted signals in the frequency band 100 MHz and below. Region 1 is bounded by aperture sizes of approximately 2 to 3 mm and waveguide thicknesses of approximately 0.5 to 2 mm. Notably, beneficial rejection of unwanted signals in the frequency spectrum between 100 MHz and 2050 MHz has also been observed.

Several waveguides with dimensions in Region 1 were found to be useful for blocking unwanted RF ingress typical of CATV applications. For example, in various embodiments an F female connector is shielded to restrict RF transfer at frequencies below 100 MHz while allowing the connector to mate with a male coaxial connector with insignificant degradation of a desired 75 ohm impedance.

Figure 6:
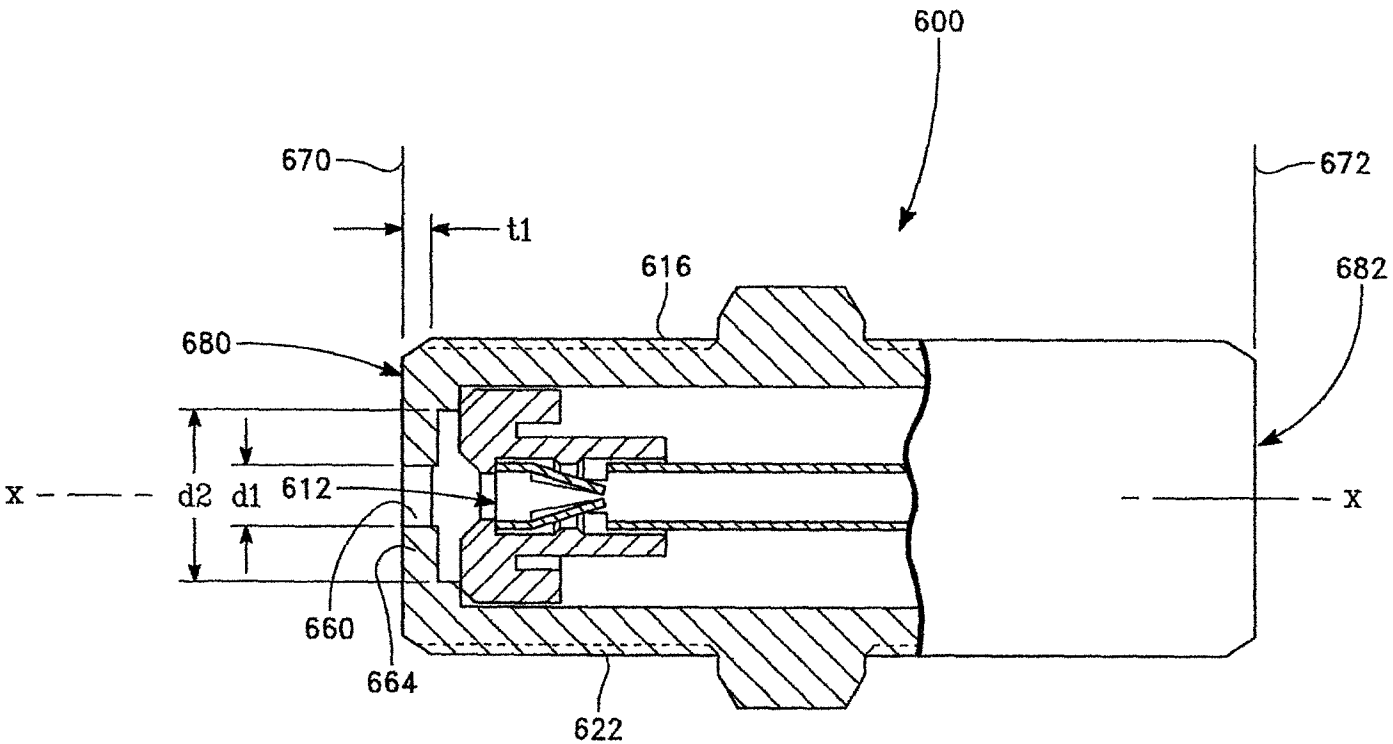
FIG. 6 shows in partial section a first embodiment of the connector with shield of the present invention.

FIG. 6 shows an F-Type splice embodiment of the present invention with an integral waveguide 600. A tubular, electrically conductive splice body 616 extends between first and second ends 670, 672 of the body locating two F female ports 680, 682. An outer diameter of the body is threaded 622 for engaging male connector(s).

A shielded port 680 with an internal contact 612 is located near the first end 670. The port is shielded by an integral waveguide in the form of an inwardly directed integral lip. Forming a centrally located and relatively small shielded port aperture 660 with diameter d1, the lip is deep as compared with prior art port lips. A lip diameter d2 (d2>d1) describes an annulus 664 between d1 and d2 having a thickness t1 measured along a central axis x-x of the connector.

Typically, only one end of the splice will have need of a shielded port given the opposite end usually remains attached to a mating male connector during the splice service life. As such, only the end opposite this undisturbed connection may typically be shielded.

In various embodiments the waveguide aperture has a diameter d1 that is smaller than the wavelength of stray RF signals to be attenuated before reaching the connector contact or other similar connector parts behind the waveguide. In various embodiments the waveguide has a thickness t1 in the range of 0.5 to 1.5 mm and an aperture diameter in the range of 2.0 to 3.0 mm. And, in various embodiments the waveguide aperture has a thickness t1 that is less than the aperture diameter (t1<d1). In an embodiment suited for use in some CATV applications, the inventor determined approximate dimensions t1=1.3 mm, d1=2.0 mm, and d2=5.5 mm provided significant attenuation of RF ingress frequencies below 100 MHz.

Figure 7:
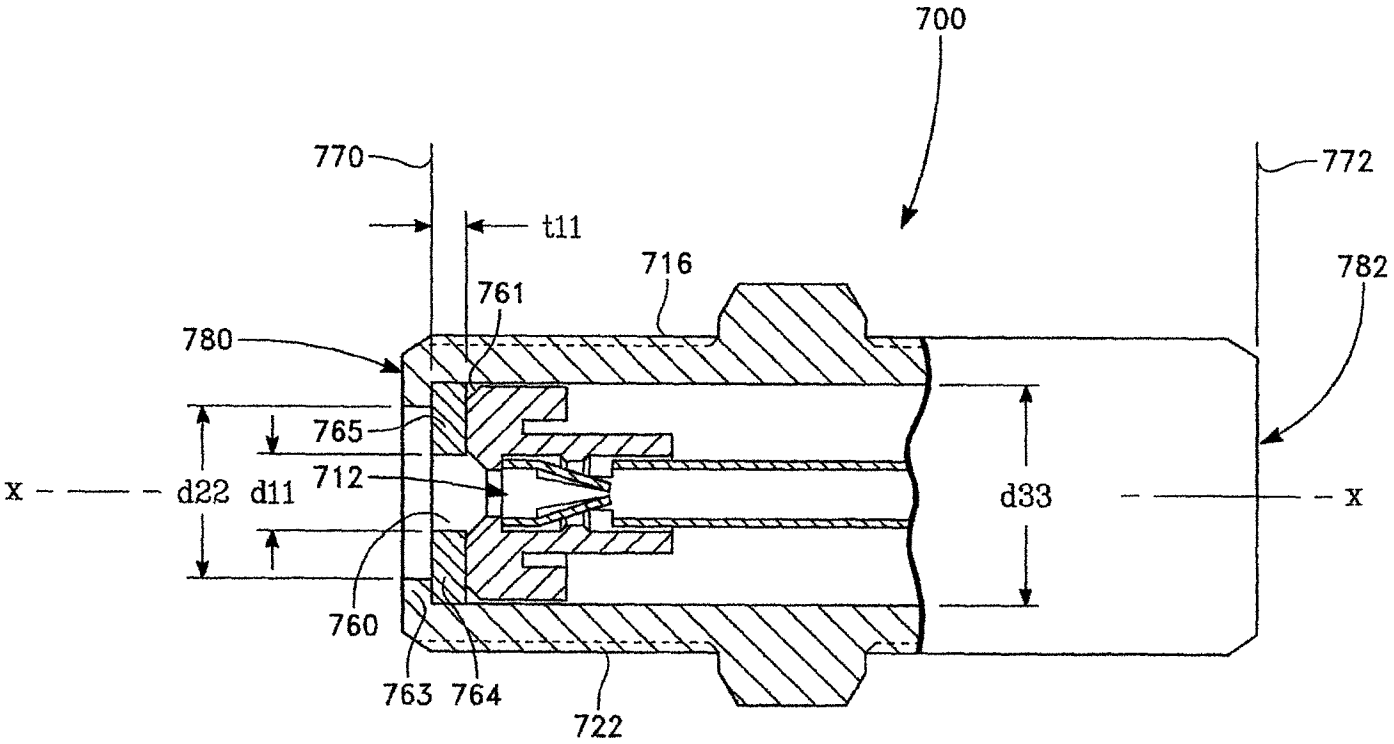
FIG. 7 shows in partial section a second embodiment of the connector shield of the present invention.

FIG. 7 shows an F-Type splice embodiment of the present invention with an disc waveguide 700. An electrically conductive splice body 716 extends between first and second ends 770, 772 of the body locating two F female ports 780, 782. An outer diameter of the body is threaded 722 for engaging male connector(s).

A shielded port 780 with an internal contact 712 is located near the first end 770. The port is shielded by a disc waveguide in the form of a perforated disc 764. As used here, disc includes any of thin or thick plates, relative to other plate dimensions, having a circular or another shape. As shown, the disc has an outer diameter d33 and a disc periphery 761 that is supported by an inwardly directed rim 763 of the connector body 716. As skilled artisans will appreciate, other methods of locating and/or supporting the disc may also be used.

The disc includes a relatively small and centrally located shielded port aperture 760 with diameter d11. The port aperture diameter d11 is less than an adjacent body end hole diameter d22. The disc defines an inwardly directed disc lip 765 that is deep as compared with prior art port lips and in some embodiments is coextensive with the disc 764. The disc has a thickness t11 measured along a central axis x-x of the connector. Typically, only one end of the splice will have need of a shielded port given the opposite end usually remains attached to a mating male connector during the splice service life. As such, only the end opposite this undisturbed connection may typically be shielded.

In various embodiments the waveguide aperture has a diameter d11 that is smaller than the wavelength of stray RF signals to be attenuated before reaching the connector contact or other similar connector parts behind the waveguide. In various embodiments the waveguide has a thickness t11 in the range of 0.5 to 1.5 mm and an aperture diameter in the range of 2.0 to 3.0 mm. And, in various embodiments the waveguide aperture has a thickness t11 that is less than the aperture diameter (t11<d11). In an embodiment suited for use in some CATV applications, the inventor determined approximate dimensions t11=1.3 mm, d11=2.1 mm, and d22=5.5 mm provided significant attenuation of RF ingress frequencies below 100 MHz.

Figure 8:
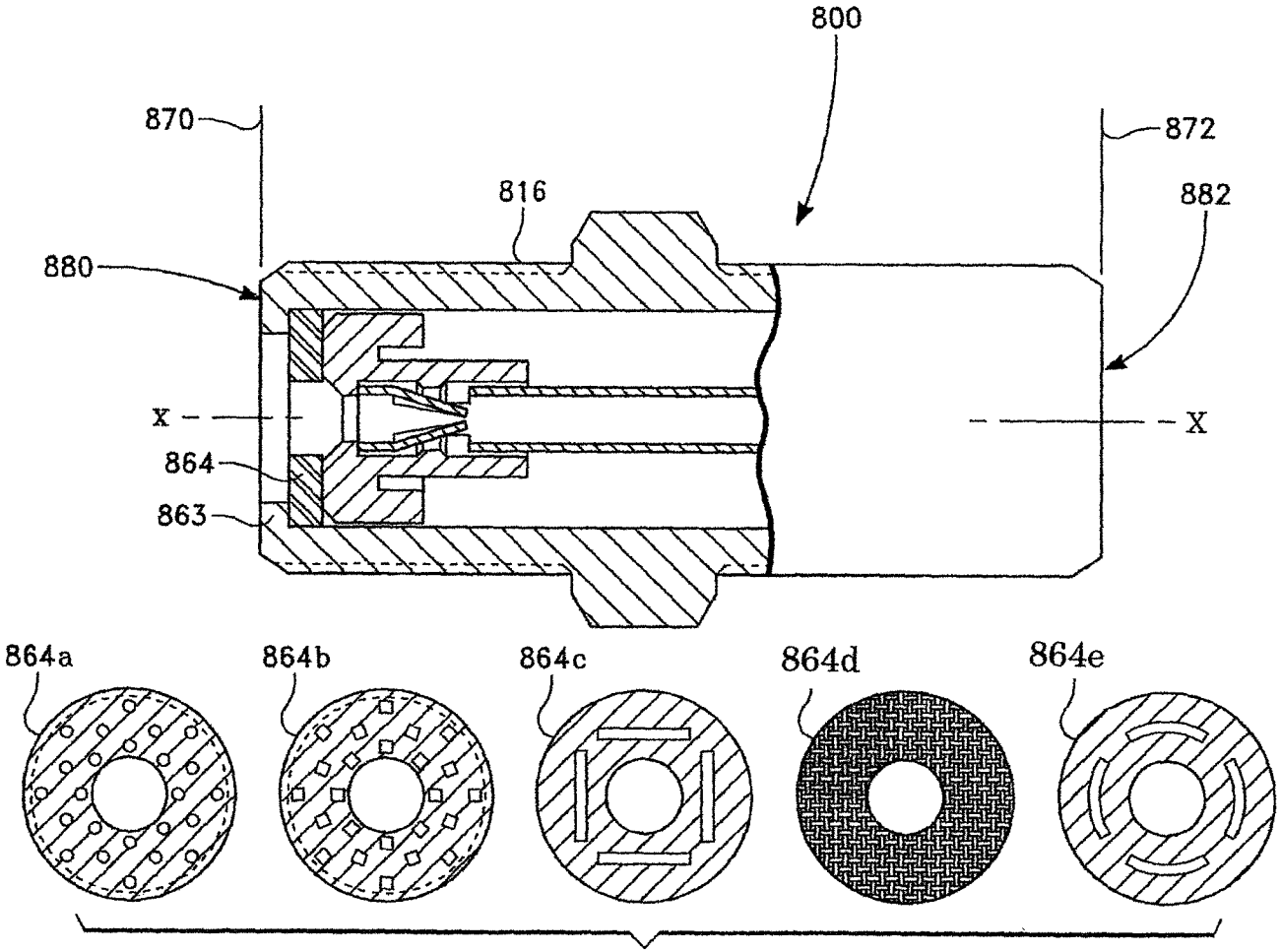
FIG. 8 shows the connector of FIG. 6 with a variety of waveguide discs.

FIG. 8 shows an F-Type splice embodiment of the present invention with a disc waveguide 800. A tubular, electrically conductive splice body 816 extends between first and second ends 870, 872 of the body locating two F female ports 880, 882.

As shown, an electrically conductive disc waveguide 864 is internal to the connector body 816 and is near a locating and/or supporting part such as an inwardly directed rim 863 of the connector body. As skilled artisans will appreciate, other methods of locating and/or supporting the disc may also be used. For example, a removable screw-in plug, circlip, or similarly useful device may retain the disc.

In addition to varying the size of a hole in a perforated disc such as a disc with a center hole, disc type waveguides may utilize a plurality of holes to obtain a desired performance. These holes may be of the same or different sizes and may include or exclude a center hole. Hole shapes may also be varied.

Five exemplary multi-hole discs 864*a-e* are shown in FIG. 8. A first disc 864*a* has circular center hole and additional smaller holes arranged along radii of the disc. A second disc 864*b* has a circular center hole and additional smaller rectangular or square holes arranged along radii of the disc. A third disc 864*c* has a circular center hole and comparatively narrow rectangular slots with a longitudinal axis about perpendicular to disc radii. A fourth disc 864*d* has a circular center hole and is made of a mesh with openings smaller than the centerhole. The fifth disc 864*e* has a circular centerhole and plural relatively small rectangular slots having longitudinal axes arranged about perpendicular to disc radii.

Figure 9:
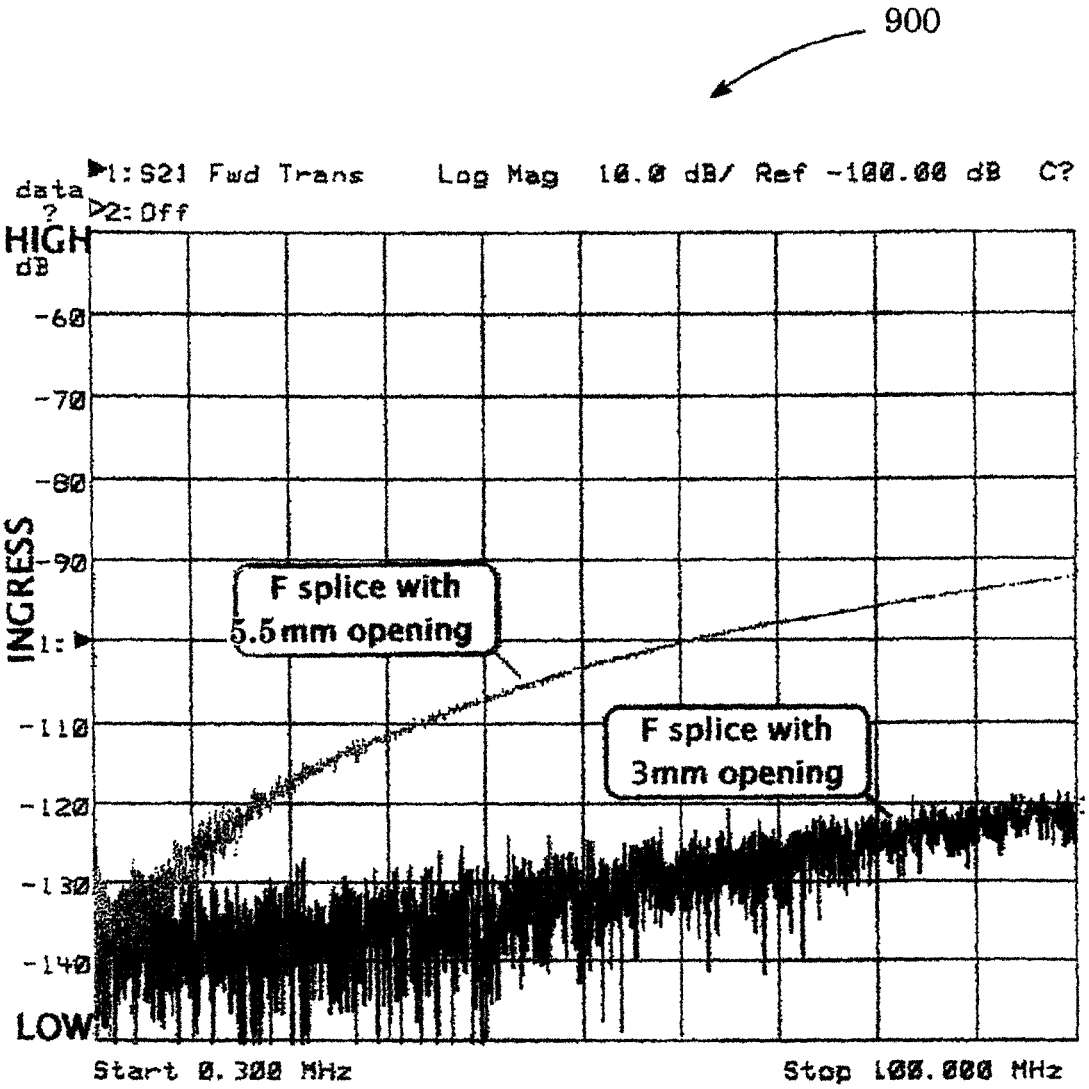
FIG. 9 shows a performance chart of one open connector embodiment of the present invention.

FIG. 9 shows performance graphs for open coaxial cable connector splices with different opening sizes 900. This chart is a digital recording of a test instrument display made during testing of a prototype connector with a port shielded in accordance with the present invention. The upper curve marked "F splice with 5.5 mm [aperture] opening" lacks the shield of the present invention and shows RF ingress that varies between about −140 dB and −90 dB over the ingress frequency range 0.3 to MHz. The lower curve marked "F splice with 3 mm [aperture] opening" includes an embodiment of the shield of the present invention and shows ingress that is much reduced, varying between about −140 dB and −120 db over the same 0.3 to 100 Mhz range of RF ingress frequencies. As can be seen from the chart, improvements in the range of about 20-40 dB can occur over the range of frequencies tested.

Figure 10:
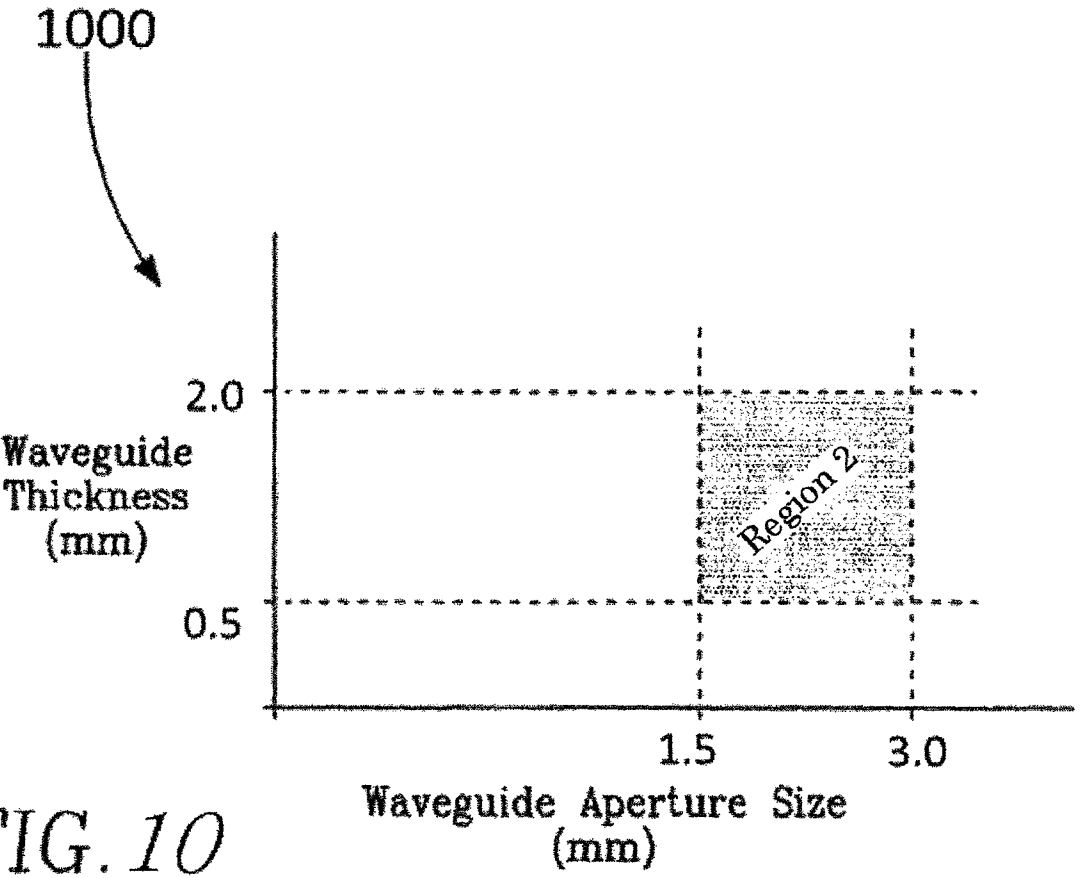
FIG. 10 shows a second chart of waveguide dimensions for some embodiments of the present invention.

FIG. 10 shows a second exemplary chart of waveguide thickness and waveguide aperture size 1000. In particular, the chart shows ranges of aperture size and thickness within a particular region, Region 2, that has been shown to yield desirable RF ingress attenuation in CATV applications. The figure illustrates thickness and aperture size ranges tested in connection with rejecting unwanted signals in CATV distribution frequency bands. Notably, beneficial rejection of unwanted signals in the frequency spectrum below 100 MHz and between 100 MHz and 2050 MHz has also been observed.

Here, the 0.3 to 1000 MHz and in particular the 700-800 MHz frequency band is of interest due to cellular telephone signal ingress such as 4G and/or LTE phone signal ingress in a cell phone/CATV an overlapping (700-800 MHz) frequency range. Region 2 is bounded by aperture sizes of approximately 1.5 to 3 mm and waveguide thicknesses of approximately 0.5 to 2 mm.

Figure 11A:
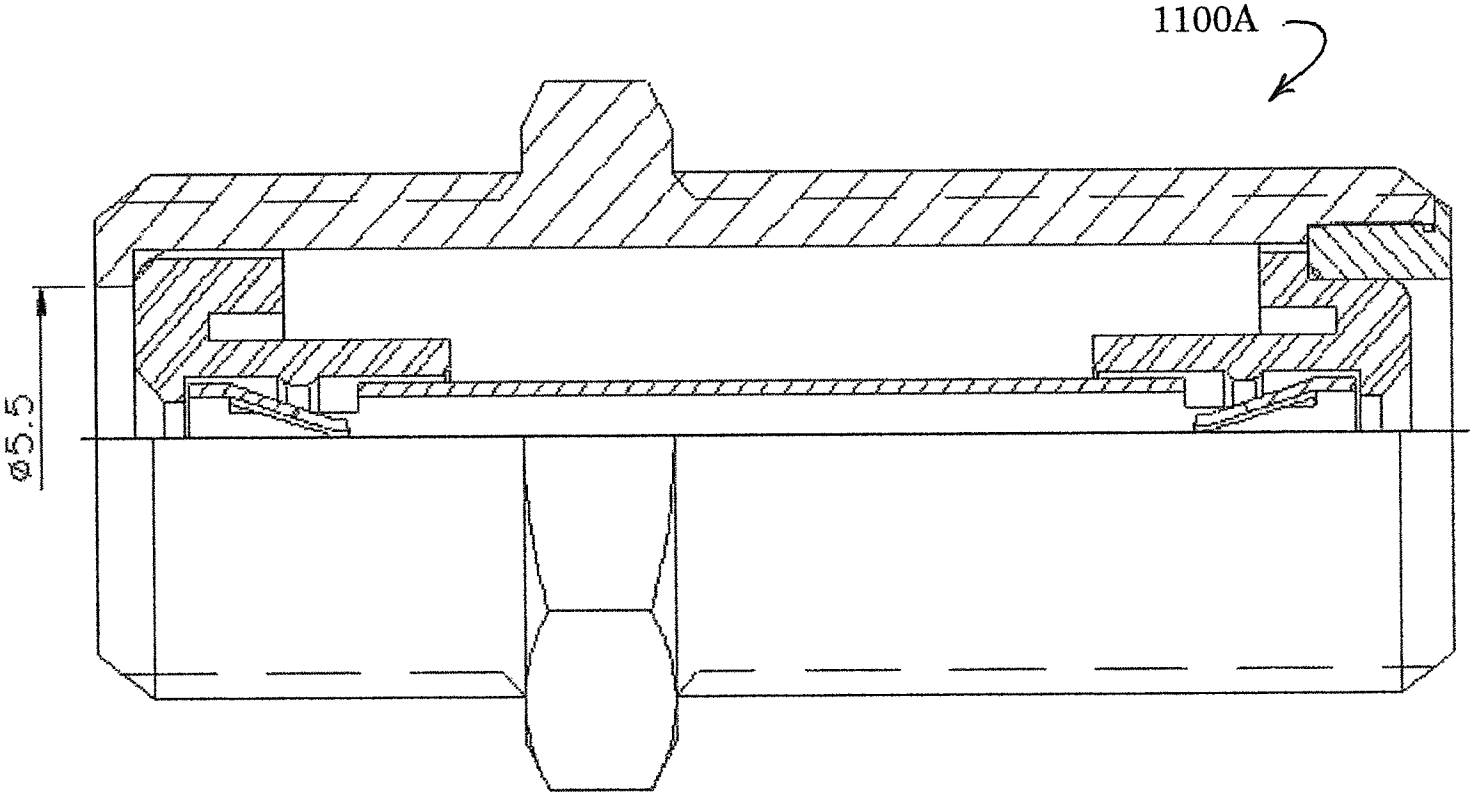
FIGS. 11A-B show a first coaxial cable connector and a related signal ingress performance chart.

FIG. 11A shows an F type splice 1100A with a 5.5 mm aperture, a feature that can be implemented, for example, by deforming the end of the splice body to form an inwardly directed lip that defines the aperture.

Figure 11B:
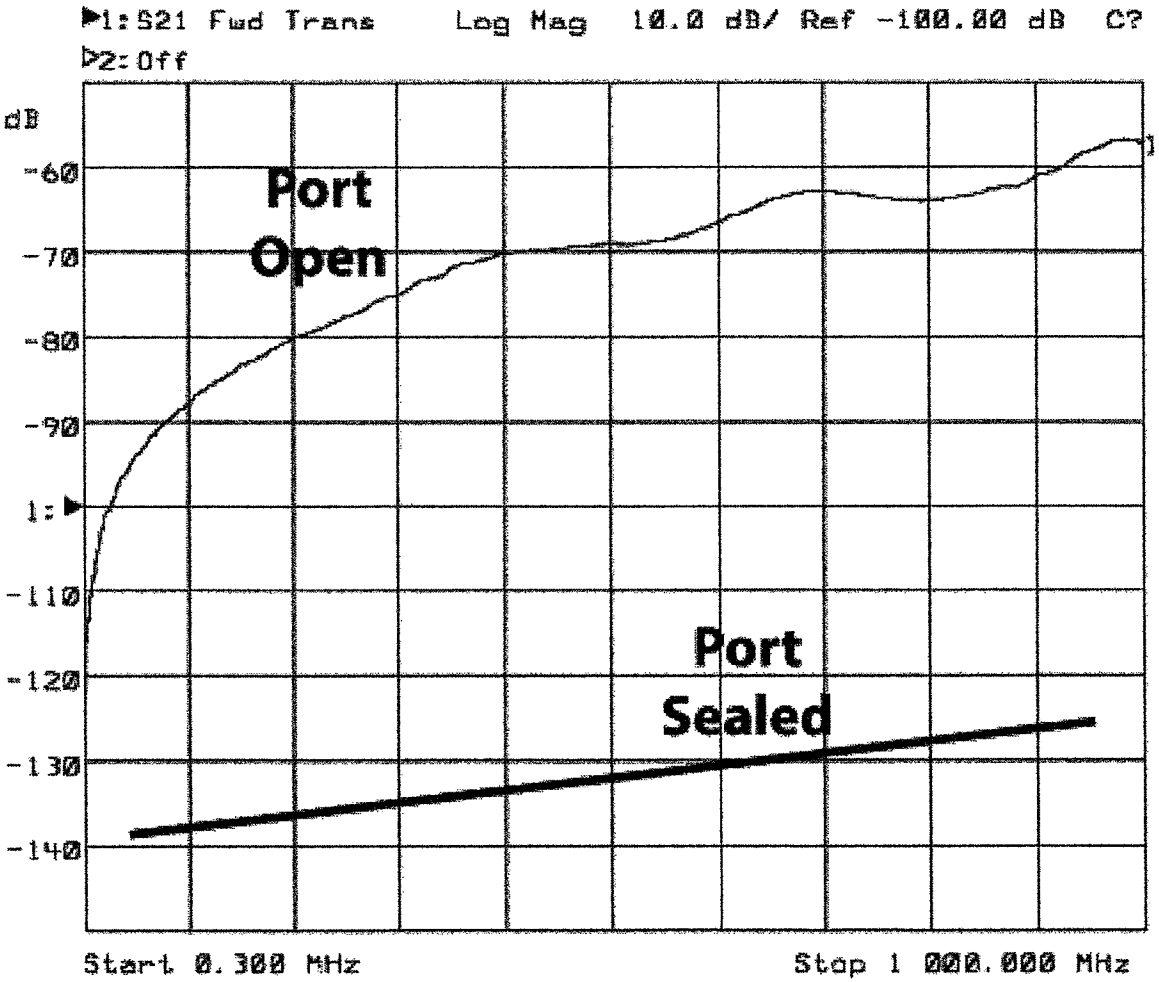

FIG. 11B shows attenuation performance 1100B of the splice of FIG. 11A under two different conditions. Larger negative dB values are desirable as they indicate greater attenuation of undesirable ingressing signals. The upper curve of this graph shows the port open condition, for example when the splice is mounted in a wall plate as shown in FIG. 1. Port open means the exposed port of the splice is disconnected while the hidden/in-the-wall port of the splice is connected to a CATV distribution system. The lower curve of this graph shows the port closed condition, for example when the above described exposed port is capped as with a screw-on cap, to block signal ingress. Differences between port open and port closed performance are shown in the table below.

Performance with 5.5 mm Aperture, Connector of FIG. 11A

| | 0.300 MHz | 1000 MHz |
|---|---|---|
| Port Open | −120 dB | −63 dB |
| Port Closed | −138 dB | −125 dB |

Connectors similar to those of FIGS. 12A and 13A below have been tested and found to significantly attenuate undesirable ingressing signals in the 0.3 to 1000 MHz frequency range and in particular in the 700-800 MHZ frequency range. And, as the data shows, the waveguides reject unwanted signals while maintaining return loss values suited to CATV industry operations.

Figure 12A:
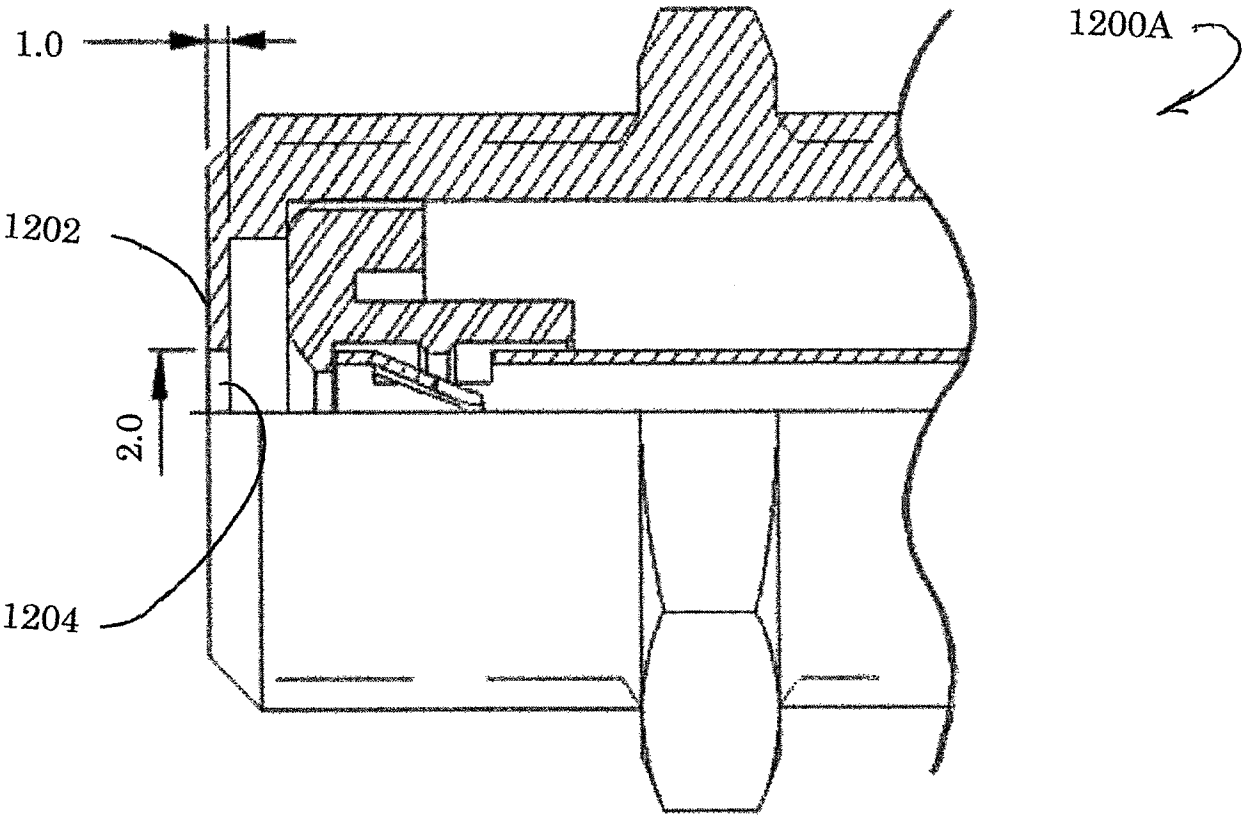
FIGS. 12A-C show a second coaxial cable connector and related performance charts.

FIG. 12A shows a portion of a coaxial cable connector with a waveguide 1200A. The waveguide 1202 is 1.0 mm thick and has a central aperture 1204 that is 2.0 mm in diameter. Notably, other than circular apertures may be used in various embodiments. For example, a triangular or other aperture shape with a similar cross-sectional area might be used here in lieu of the circular aperture.

Figure 12B:
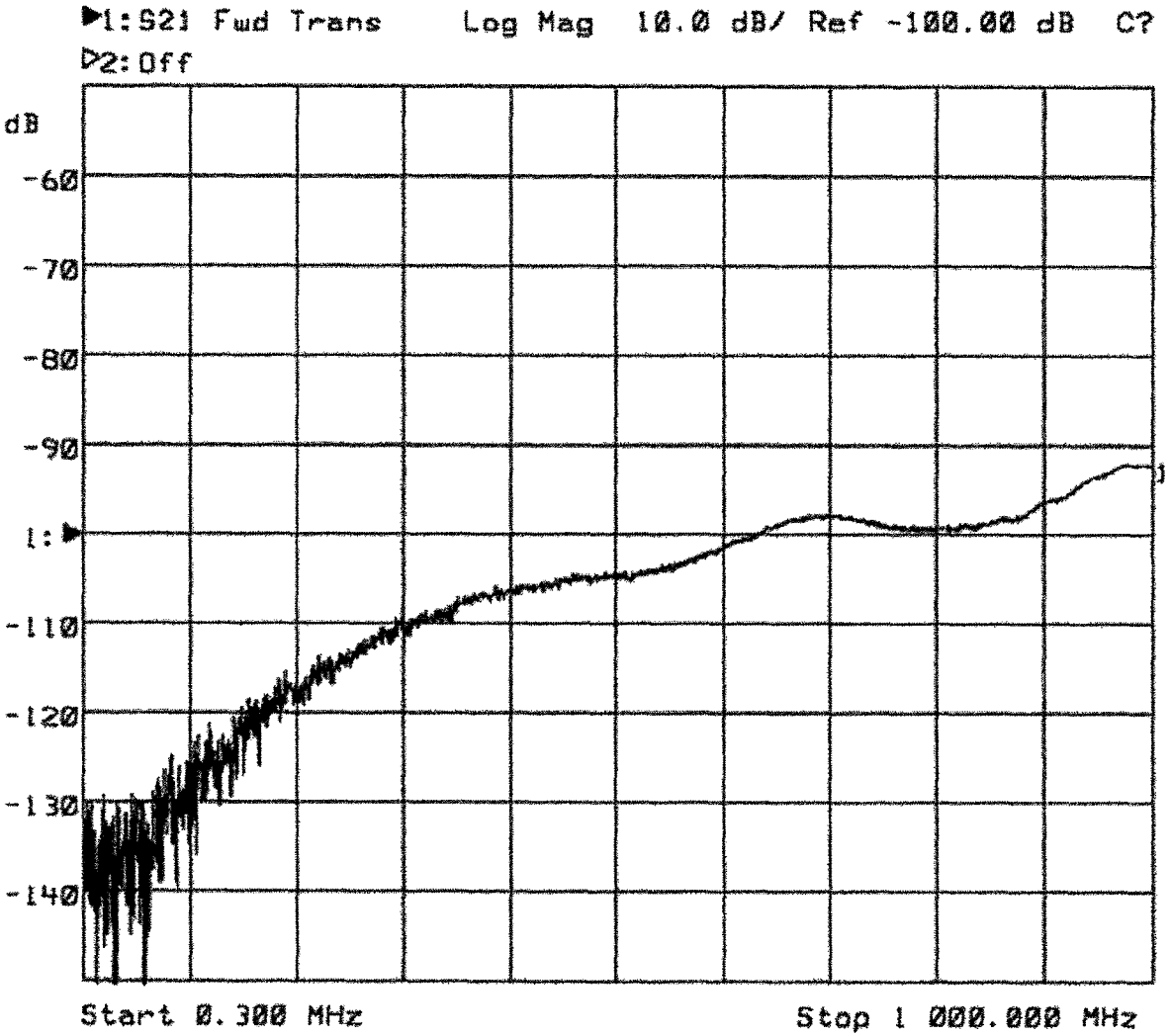

FIG. 12B shows attenuation performance 1200B of the protected connector of FIG. 12A.

Performance with 2.0 mm Aperture, Connector of FIG. 12A

| | 0.300 MHz | 1000 MHz |
|---|---|---|
| Port Open | −140 dB | −92 dB |
| Improvement Over Connector of FIG. 11A | (−140 − (−120)) = −20 dB | (−92 − (−63)) = −29 dB |

As seen, in the 0.300 MHz to 1000 MHz frequency spectrum, improved attenuation of unwanted ingressing signals is in the range of about −20 to −29 dB.

Figure 12C:
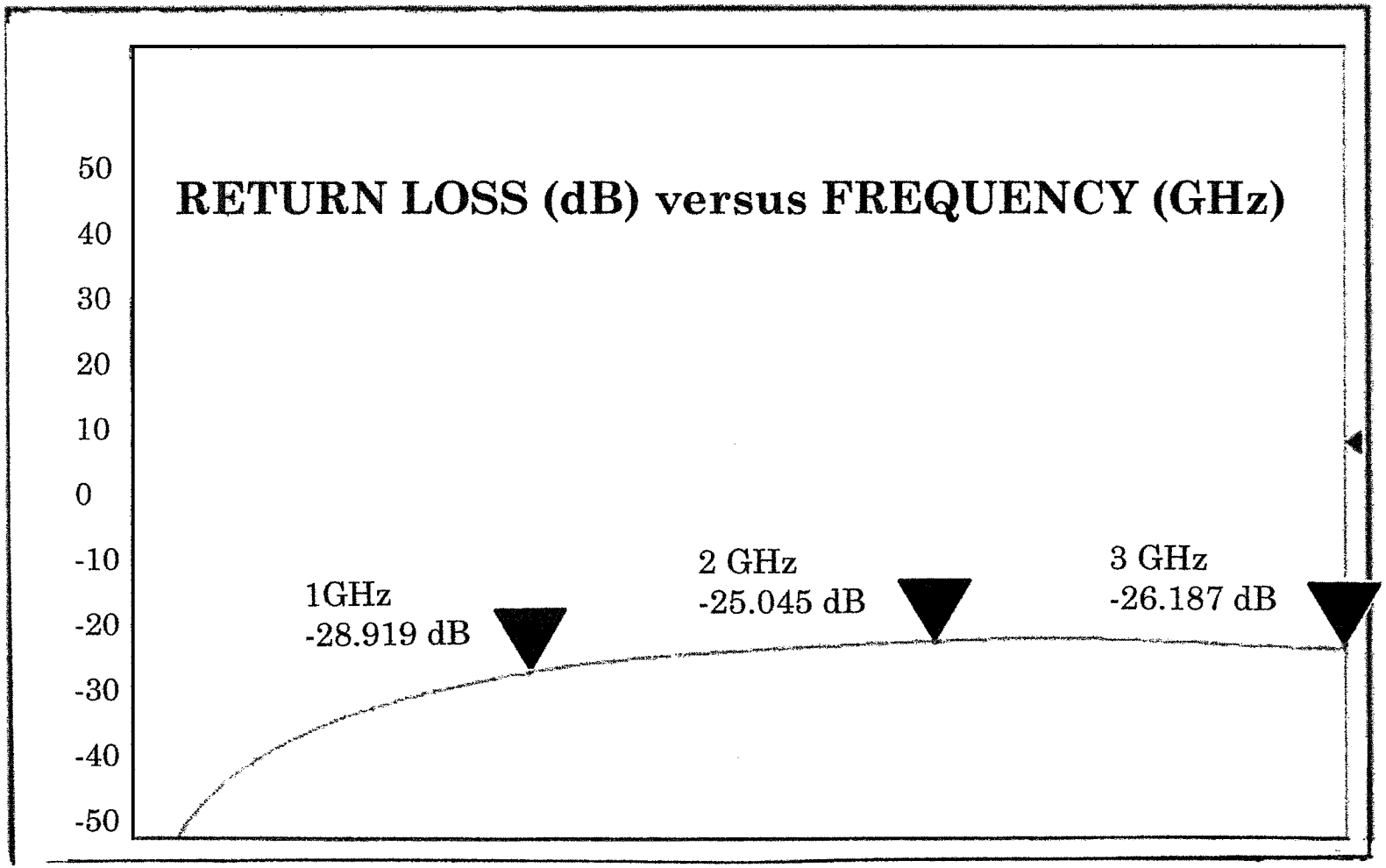

FIG. 12C shows return loss performance 1200C of the protected connector of FIG. 12A. Larger negative dB values of return loss are desirable as they indicate improved impedance matching and reduced signal reflection losses. Typical return loss values maintained in the CATV industry are in the range of about −50 to −10 dB. As seen in the figure and in the table below, return loss values for the connector of FIG. 12A are in the range of about −50 to −25 dB.

Figure 13A:
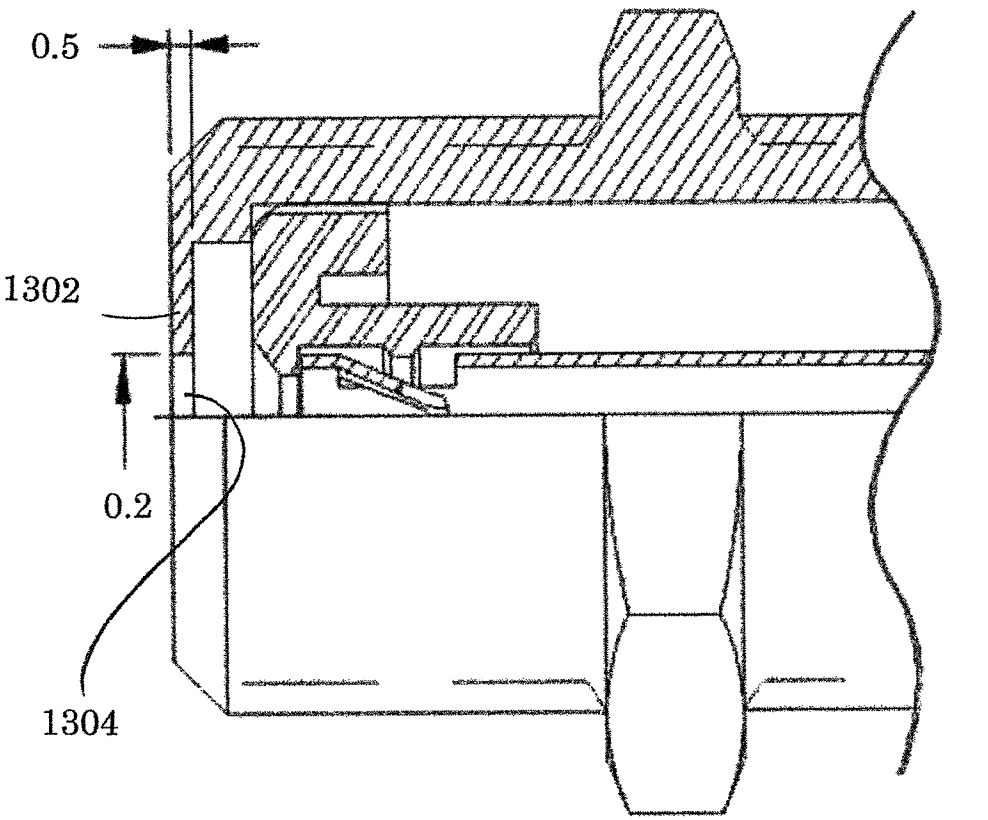
FIGS. 13A-C show a third coaxial cable connector and related performance charts.

FIG. 13A shows a portion of a coaxial cable connector with a waveguide 1300A. The waveguide 1302 is 0.5 mm thick and has a central aperture 1304 that is 2.0 mm in diameter. Notably, other than circular apertures may be used in various embodiments. For example, a triangular or other aperture shape with a similar cross-sectional area might be used here in lieu of the circular aperture.

Figure 13B:
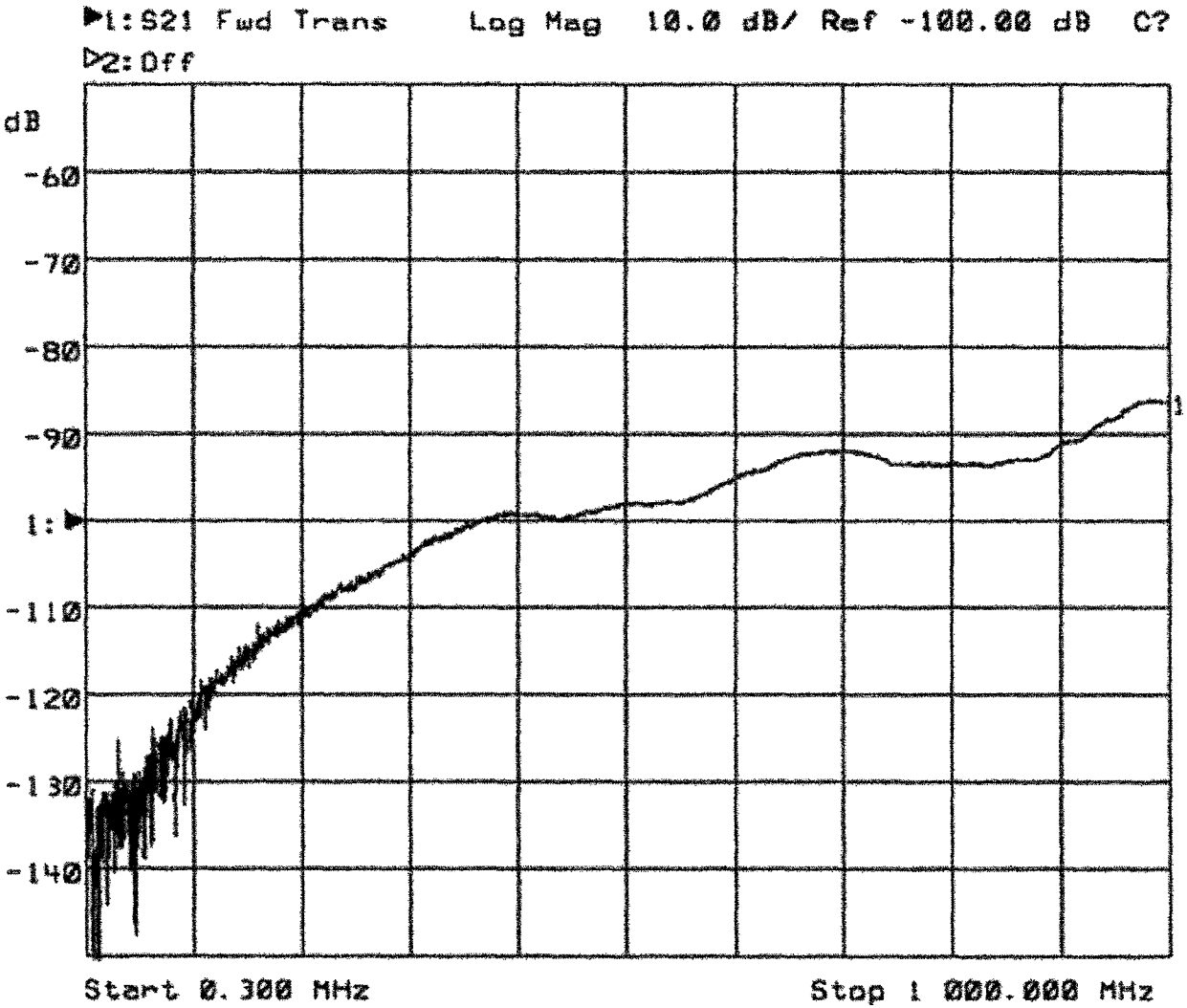

FIG. 13B shows attenuation performance 1300B of the protected connector of FIG. 13A.

Performance with 2.0 mm Aperture, Connector of FIG. 13A

| | 0.300 MHz | 1000 MHz |
|---|---|---|
| Port Open | −140 dB | −86 dB |
| Improvement Over Connector of FIG. 11A | (−140 − (−120)) = −20 dB | (−86 − (−63)) = −23 dB |

As seen, in the 0.300 MHz to 1000 MHz frequency spectrum, improved attenuation of unwanted ingressing signals is in the range of about −20 to −23 dB.

A lip diameter d2 (d2>d1) describes an annulus 664 between d1 and d2 having a thickness t1 measured along a central axis x-x of the connector.

Figure 13C:
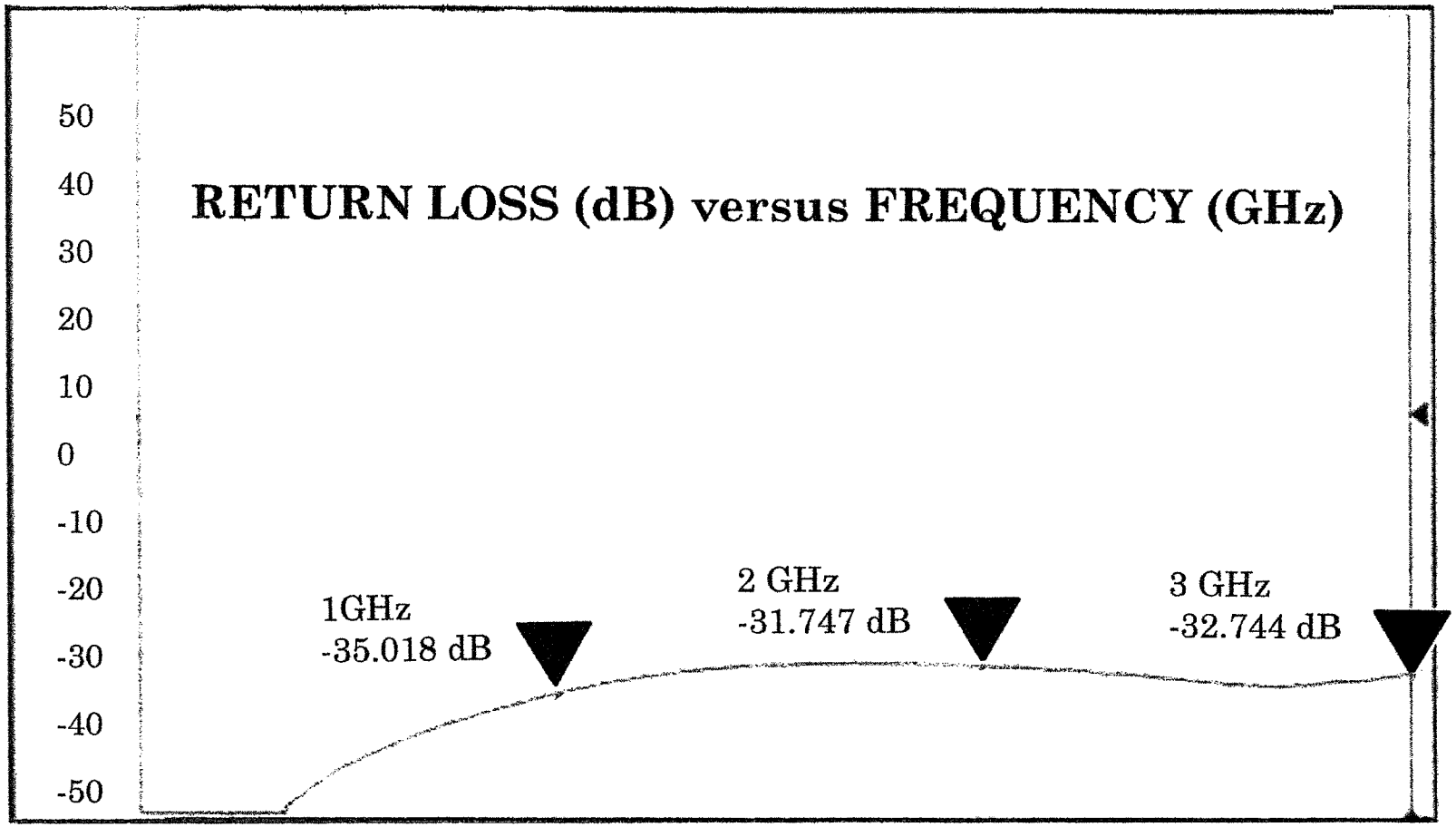

FIG. 13C shows return loss performance 1300C of the protected connector of FIG. 13A. Larger negative dB values of return loss are desirable as they indicate improved impedance matching and reduced signal reflection losses. Typical return loss values maintained in the CATV industry are in the range of about −50 to −10 dB. As seen in the figure and in the table below, return loss values for the connector of FIG. 13A are in the range of about −50 to −32 dB.

Turning now to some alternative waveguide configurations, FIGS. 14A-C, 15, and 16A,B show waveguides installed in bulkhead connectors and connectors such as ports and splices.

Figures 14A, 14B, 14C:
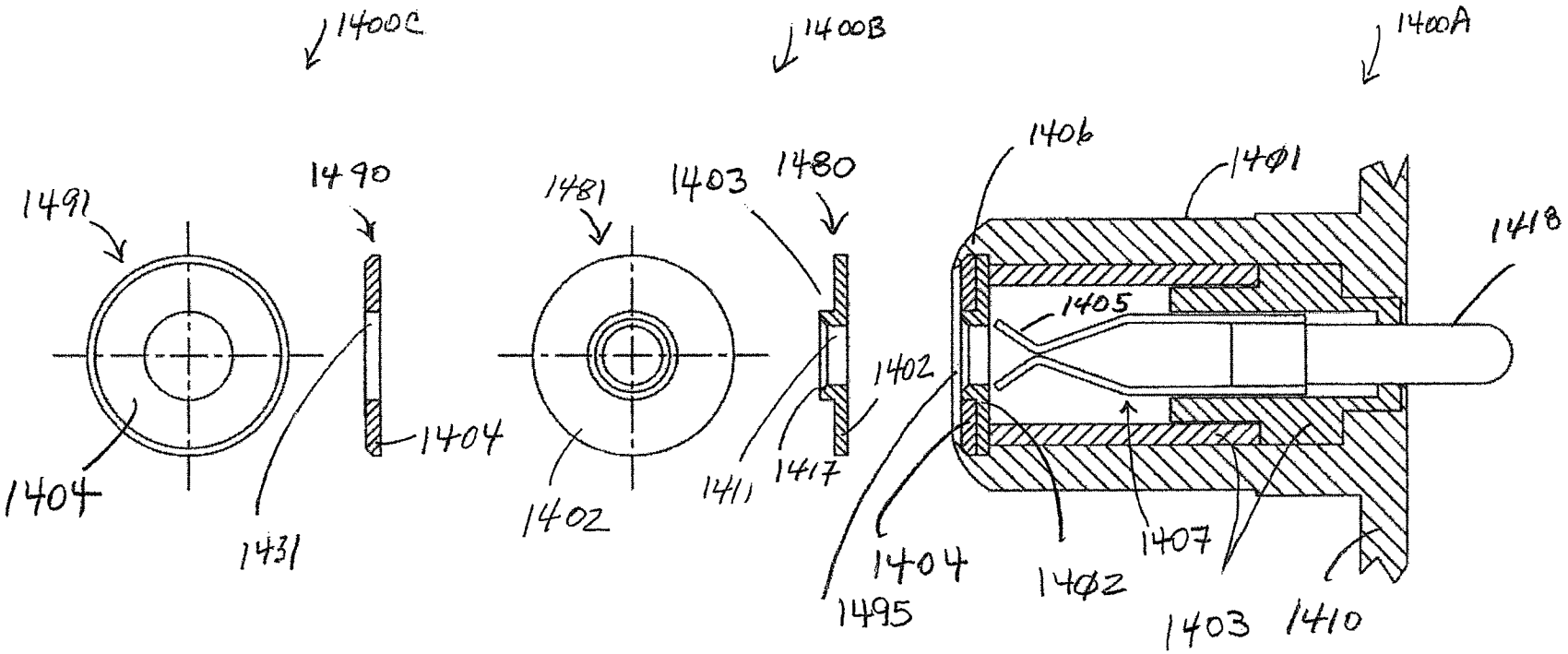
FIGS. 14A-C show a fourth coaxial connector including a waveguide.

FIG. 14A shows a connector such as a bulkhead mountable or bulkhead integral connector 1400A. A connector body 1401 is supported by a connector base 1410 and an insulating structure(s) 1403 within the connector body support a central electrical contact 1407 having a coaxial cable center conductor contactor 1405 and an opposed contacting pin 1418 near the base.

Access to the center conductor contactor 1405 is via an adjacent body end opening 1495. An annular waveguide 1402 located in this opening is adjacent to the center conductor contactor. In some embodiments, an outer ring 1404 abuts the waveguide. In various embodiments, the waveguide is held in place by a deformed or staked end of the body 1406 that overlaps the waveguide or outer ring.

FIG. 14B shows the waveguide 1400B. Profile 1480 and end 1481 views show the annular structure of the waveguide. As seen in the profile view, an embodiment of the waveguide includes a generally cylindrical waveguide lip 1403. The lip encircles and projects from the waveguide aperture 1411 to define a coaxial cable center conductor mouth. Some embodiments include a lip internal entry taper 1417 that guides a coaxial cable central conductor into the waveguide aperture 1411.

FIG. 14 C shows the optional outer ring embodiment 1400C. Profile 1490 and end 1491 views show the annular structure of the outer ring 1404. As seen in the profile view, the ring forms a lip receiving hole 1431 for receiving the waveguide lip 1403 as shown in FIG. 14A.

In a connector embodiment 1400A including the outer ring 1404, one closure method incorporates a metal or RF conductive waveguide 1402 used in an F female port with a deformable waveguide fixing end such that horizontal port cast metal bodies may be equipped with the waveguide. In yet another embodiment of FIGS. 14A-C, annotated item 1402 is the insulator and annotated item 1404 is the waveguide.

Figure 15:
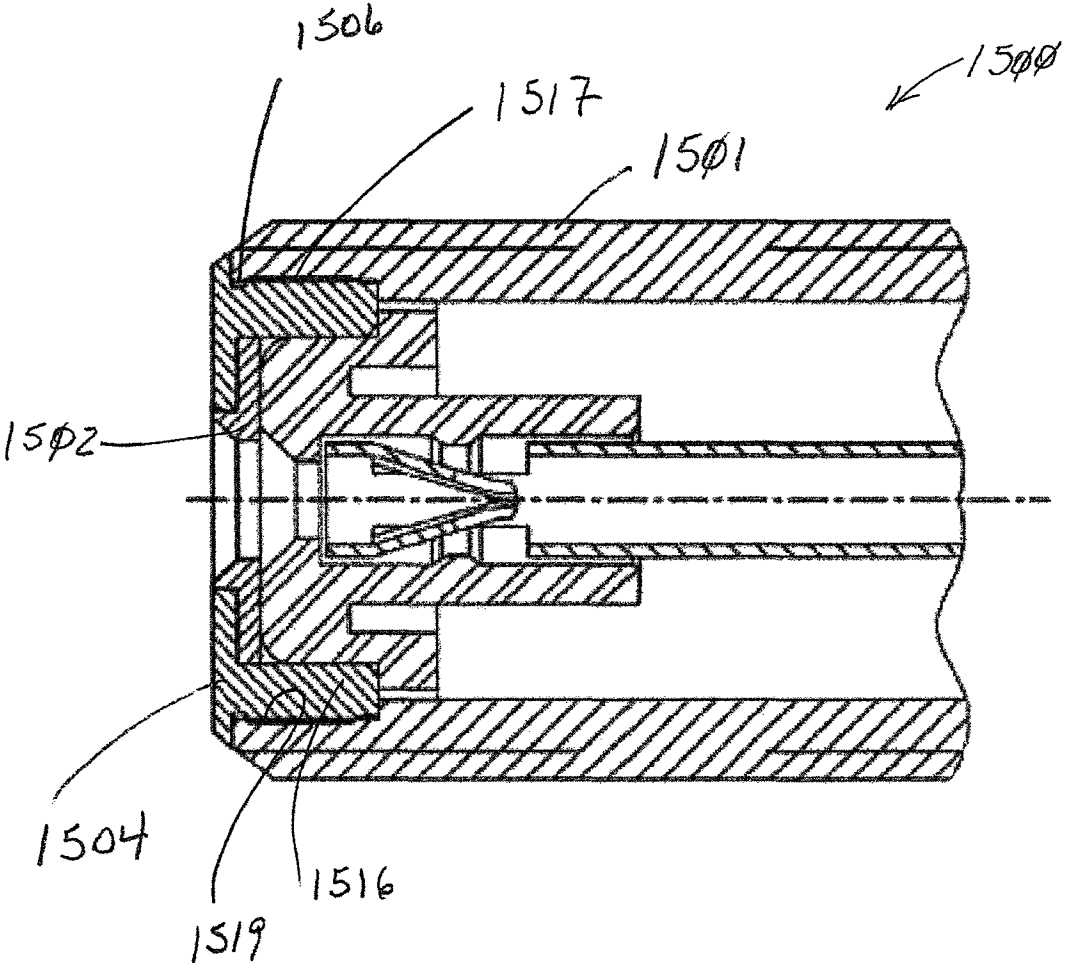
FIG. 15 shows a fifth coaxial connector including a waveguide.

FIG. 15 shows a connector female port 1500. As discussed in connection with FIGS. 14A-C above, the port of FIG. 15 utilizes a waveguide 1502 and an outer ring 1504 such as an interengaging waveguide and ring. These parts are fitted into a connector body 1501 opening 1506 and an extended cylindrical shank 1516 of the outer ring provides a fixation means, for example an interference fit 1517 with a bore 1519 of the body.

Figure 16B:
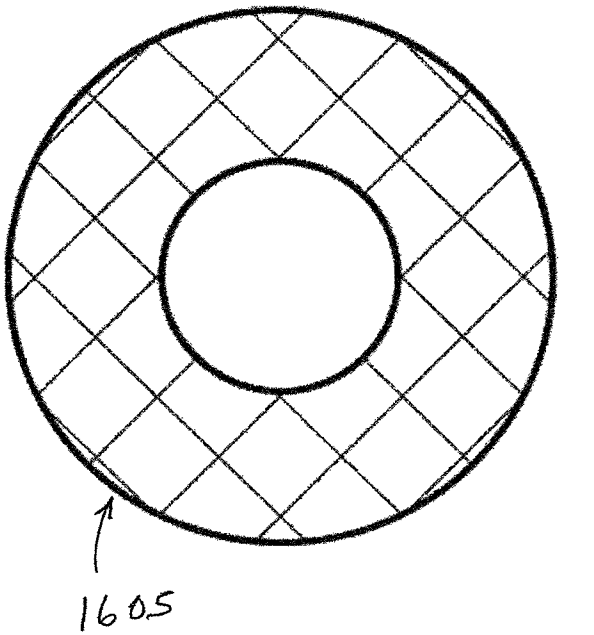
FIGS. 16A-B show a coaxial cable connector insulator with a waveguide.
Figure 16A:
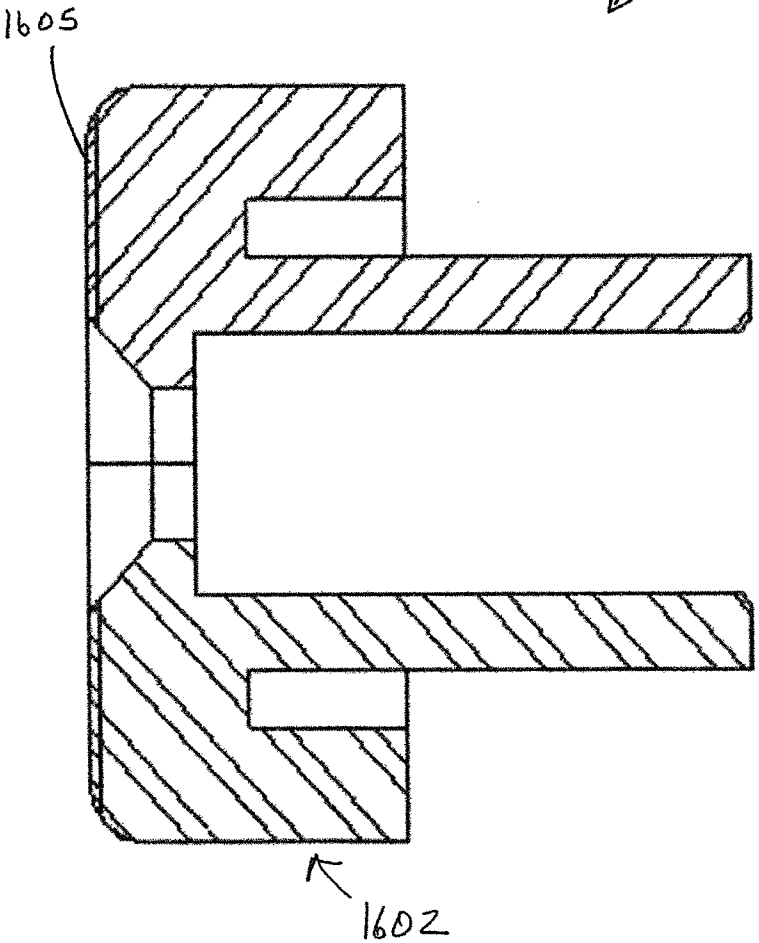

FIGS. 16A,B show a coaxial connector port insulator and waveguide 1600A,B. In particular, FIG. 16A shows a connector port insulator 1602 together with a waveguide 1605. FIG. 16 B shows the waveguide 1605. In some embodiments, the waveguide is a separable disc. And, in some embodiments, the waveguide is integral with the insulator and includes one or more of the following: an RF shielding material that is a coating, an impregnate, a commix with insulator plastic, an insert, and the like. In an embodiment, the waveguide is a metallic plating on the cable entry side of the insulator. In an embodiment, the waveguide is a metallic plating on the surface of the cable entry side of the insulator.

FIGS. 17A-C, 18A-D, 19A-E, 20A-D, 21A-C (i.e., FIGS. 17A-21C) show connectors with waveguides. In particular, the waveguides of these figures have insulated apertures or throats.

Figures 17A, 17B:
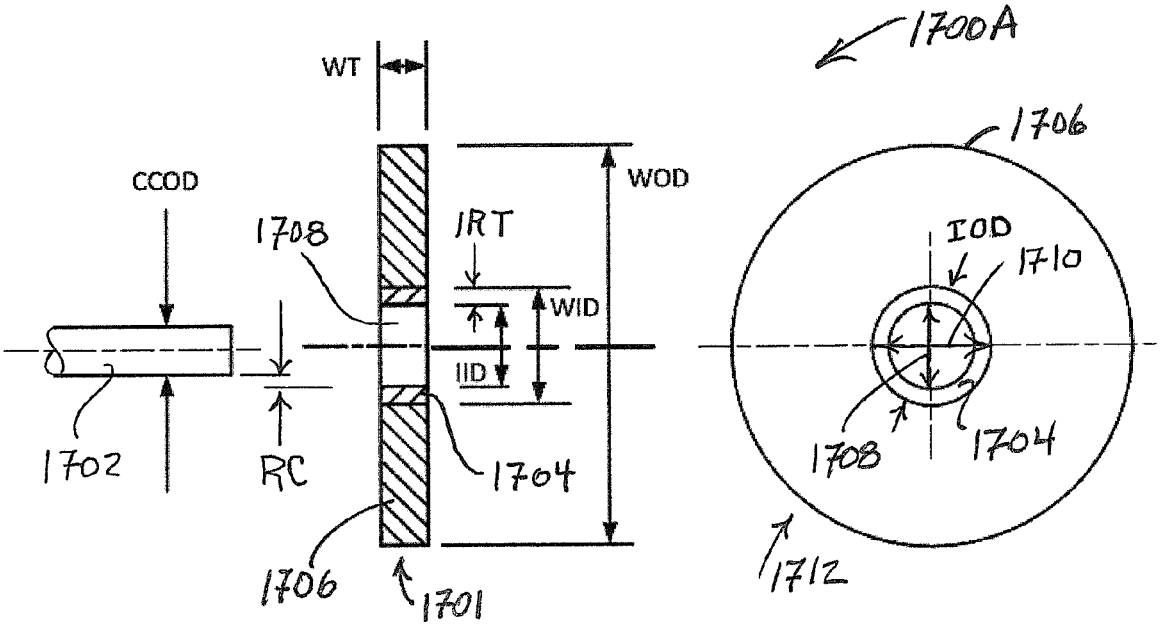
FIGS. 17A-C show a first insulated aperture waveguide.

FIG. 17A shows a first insulated aperture waveguide and a center conductor portion 1700A. The insulated aperture waveguide is shown in cross sectional 1701 and end 1712 views. In various embodiments, the waveguide may be described or partially described as a web or web portion bordering an aperture. Adjacent to the cross sectional view is a center conductor 1702 for insertion in the insulator.

As shown, an electrical insulator 1704, such as a cylindrical plastic insulator, is inserted in a central aperture 1710 of a disk like waveguide 1706. An insulator through hole 1708 provides a passageway through the waveguide 1706 such that the center conductor does not touch or short circuit with the waveguide. Not shown are insulator portions which may lie to either side of the waveguide. In some embodiments, the aperture insulator may be segmented and/or have a snap-in type design. And in some embodiments, the aperture insulator may be an insulative coating.

Waveguide 1706 dimensions include a waveguide thickness (WT), a waveguide outer diameter or major dimension (WOD), and a waveguide aperture diameter (WID). Insulator dimensions include an insulator through hole diameter or inside dimension (IID) and an insulator outer diameter or major dimension (IOD) that allows for fitting the insulator within the waveguide aperture. In various embodiments, IOD is chosen such that the insulator 1704 engages the waveguide aperture 1710 with a slip or an interference fit for a given WID. As persons of ordinary skill in the art will observe, a radial wall thickness of the insulator (IRT) may be approximated as IRT=((WID−IID)/2).

FIG. 17B shows a table of insulated aperture waveguide dimensions for use with center conductors having dimensions similar to those of RG59 and RG6 coaxial cable 1700B. Skilled artisans will appreciate that ranges in WID of 2.0 to 3.0 mm may result in corresponding ranges of IID of 1.4 to 2.4 mm. In various embodiments, a nominal radial clearance (RC) between a center conductor 1702 having a center conductor outer diameter (CCOD) and the insulator 1704 ranges for RG59 from 0.4 to 1.4 mm and for RG6 from 0.19 to 1.19 mm.

Figure 17C:
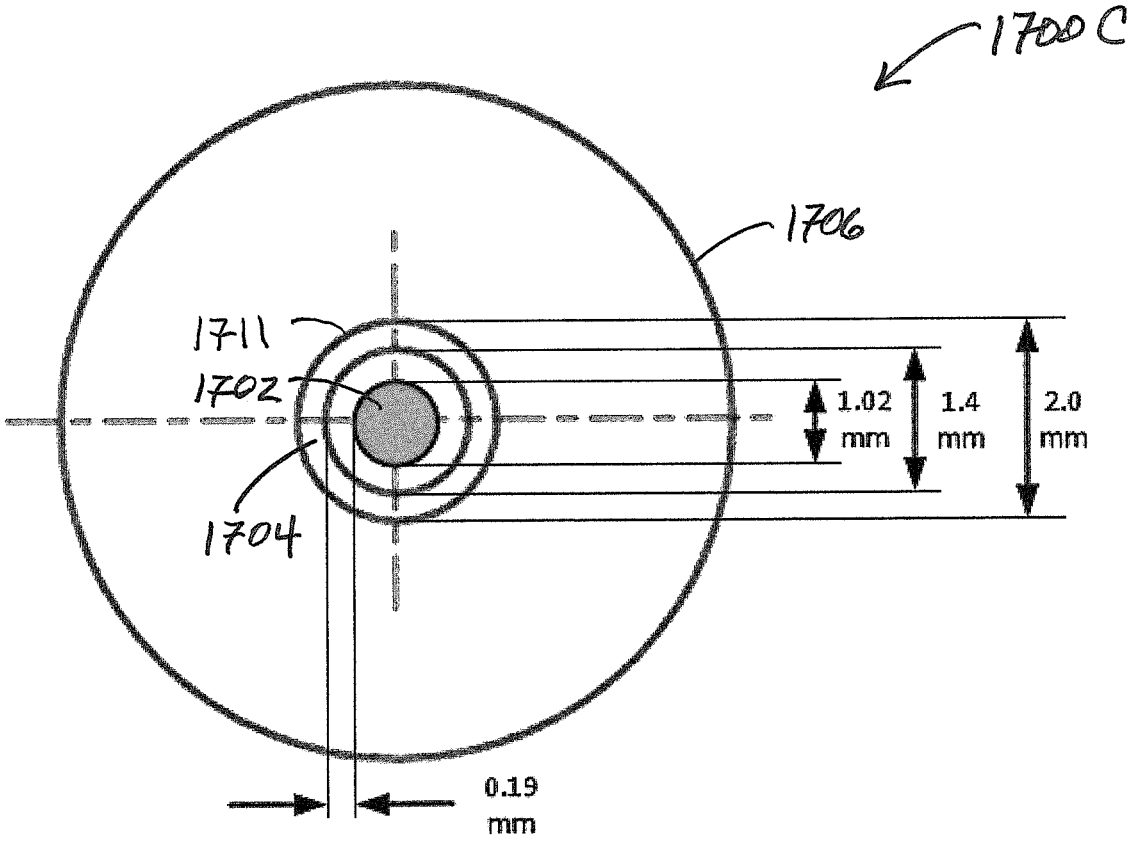

FIG. 17C shows a dimensioned example of an insulated aperture waveguide 1700C. For example, a 2.0 mm waveguide aperture diameter and a 0.3 mm insulator wall thickness provide an insulator through hole diameter of 1.4 mm for passing an RG6 center conductor with a 1.02 mm OD. As shown, a radial center conductor to insulator clearance RC of approximately 0.19 mm results.

The insulated aperture waveguide may be used in coaxial connectors including splicing or coupling connectors such as connectors for splicing two coaxial cables and terminating connectors such as female coaxial connector ports on radio frequency equipment. In various embodiments, insulated aperture waveguides are used with coaxial cable connector splices and with satellite television set top boxes.

FIGS. 18A, 19A, 20A, 21A show insulated aperture waveguides installed in coaxial connector splices 1800A, 1900A, 2000A, 2100A. Skilled artisans will appreciate that the insulated aperture waveguide end of the splice also discloses the making and using of a similar insulated aperture waveguide in a female coaxial connector port.

Figure 18A:
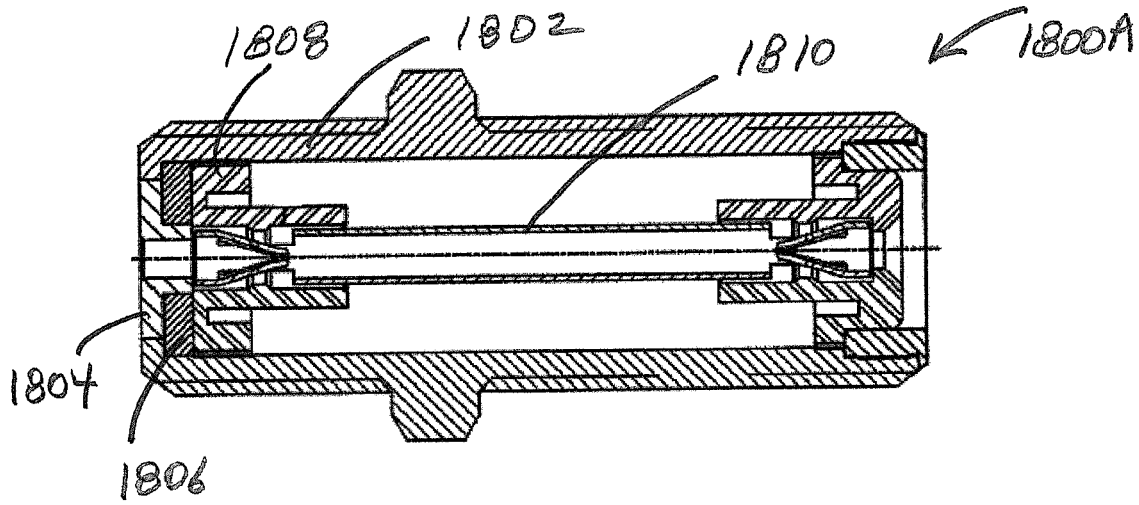
FIGS. 18A-D show a second insulated aperture waveguide.

FIGS. 18A-D show a splice having a second insulated aperture waveguide 1800A-D. As seen in FIG. 18A, the insulated aperture waveguide includes a waveguide 1806 and a first or outside mount insulator 1804. The waveguide is located between the first insulator and a second insulator 1808 that supports a center pin 1810 within the body 1802 of the connector.

Figure 18B:
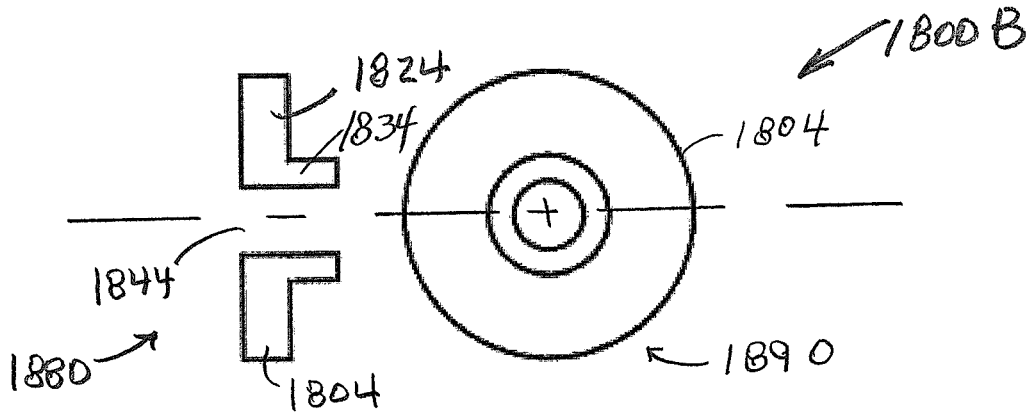
Figure 18C:
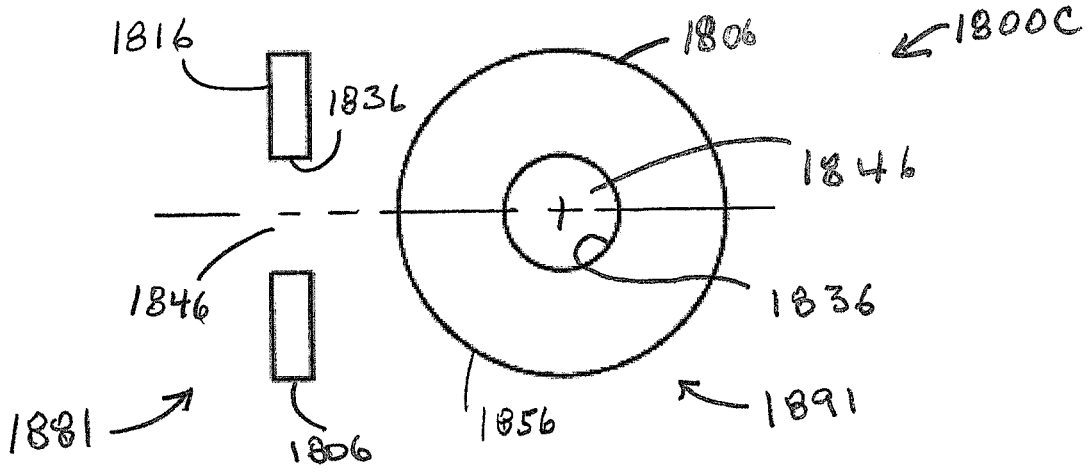

FIG. 18B shows cross sectional 1880 and end 1890 views of the outside mount insulator 1804. An insulator flange 1824 adjoins a coaxially arranged insulator neck 1834 that is for insertion in a waveguide aperture 1846 (see FIG. 18C). An insulator through hole 1844 is for receiving a center conductor while the insulator flange guards against center conductor (see e.g. 1702 of FIG. 17A) contact with a waveguide front face 1816 (see also FIG. 18C) and the insulator neck guards against center conductor contact with a waveguide aperture wall 1836. In various embodiments the waveguide through hole may include a chamfer (not shown) to guide entry of an insertable center conductor, for example the center conductor of a coaxial cable FIG. 18C shows cross sectional 1881 and end 1891 views of the waveguide 1800C. The waveguide 1806 may be formed as a disk like structure that extends radially or somewhat radially between a central aperture 1846 and an outer perimeter 1856. In various embodiments, the waveguide central aperture may be cylindrical as shown.

Figure 18D:
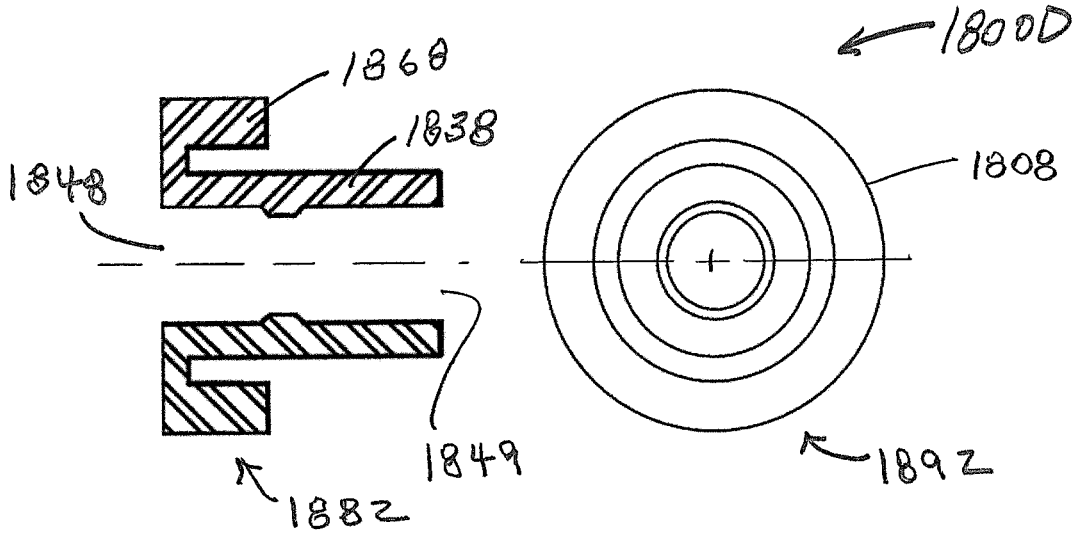

FIG. 18D shows cross sectional 1882 and end 1892 views of the second insulator 1808. The second insulator includes a central tubular section 1838 with a mouth 1848 adjacent to the waveguide aperture 1846 (see FIG. 1800A) and a rear entry 1849 for receiving the connector center pin 1810. In various embodiments, a coaxially arranged collar 1868 encircles and is attached to the tubular section.

Figure 19A:
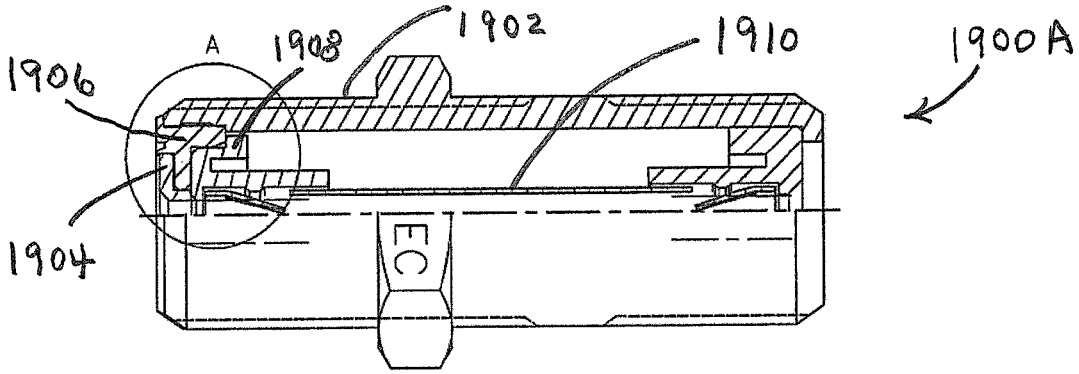
FIGS. 19A-E show a third insulated aperture waveguide.

FIGS. 19A-E show a splice having a third insulated aperture waveguide 1900A-E. As seen in FIG. 19A, the insulated aperture waveguide includes a waveguide 1906 and a first or outside mount insulator 1904. An inner rim of the waveguide 1996 that bounds a waveguide aperture 1946 (see also FIG. 19C) is located between the first insulator and a second insulator 1908. The second insulator supports a center pin 1910 within the body 1902 of the connector.

Figure 19B:
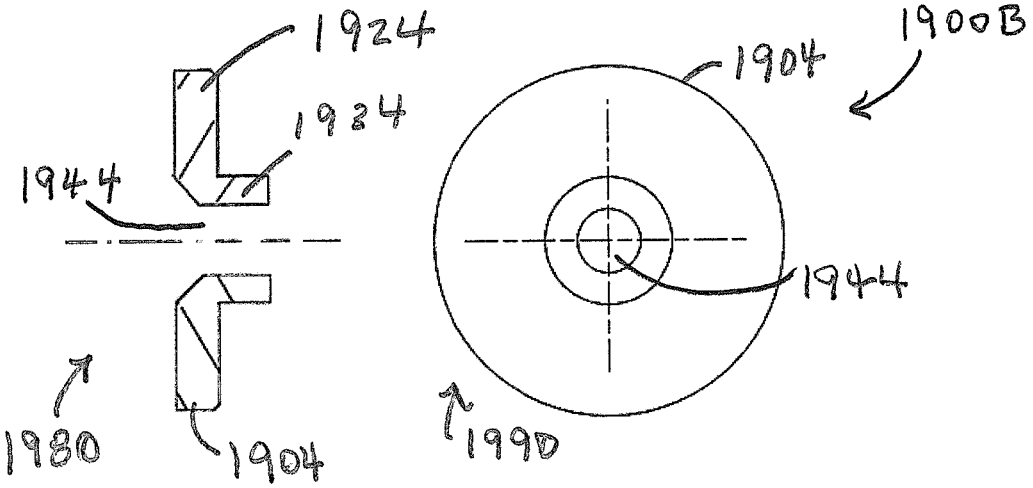

FIG. 19B shows cross sectional 1980 and end 1990 views of the outside mount insulator 1904. An insulator flange 1924 adjoins a coaxially arranged insulator neck 1934 that is for insertion in a waveguide aperture 1946 (see FIG. 19C). An insulator through hole 1944 is for receiving a center conductor (see e.g. 1702 of FIG. 17A) while the insulator flange guards against center conductor contact with a waveguide front face 1916 (see also FIG. 19C) and the insulator neck guards against center conductor contact with a waveguide aperture wall 1936.

Figure 19C:
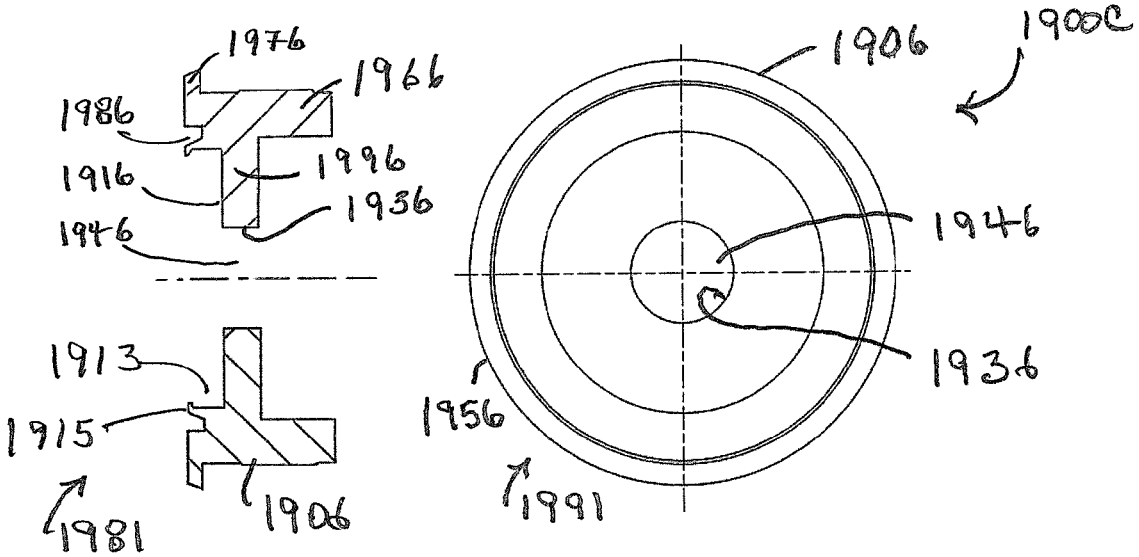

FIG. 19C shows cross sectional 1981 and end 1991 views of the waveguide 1900C. The waveguide 1906 may be formed as a disk like structure that extends radially or somewhat radially between a central aperture 1946 and an outer perimeter 1956. As shown, the waveguide includes an outer cylinder 1966 and the waveguide inner rim 1996 extends inwardly from the cylinder and bounds a waveguide aperture 1946. A waveguide front cavity 1913 for receiving the insulator 1904 has boundaries including the rim and the cylinder such that a cylinder face recess 1986 provides a bendable stake or tang like structure 1915 for fixing the insulator within the cavity. An outwardly directed cylinder rim 1976 is for seating against the connector body 1902.

In various embodiments, the waveguide central aperture may be cylindrical as shown and in other embodiments the aperture may have straight or non-cylindrically curved boundaries.

Figure 19D:
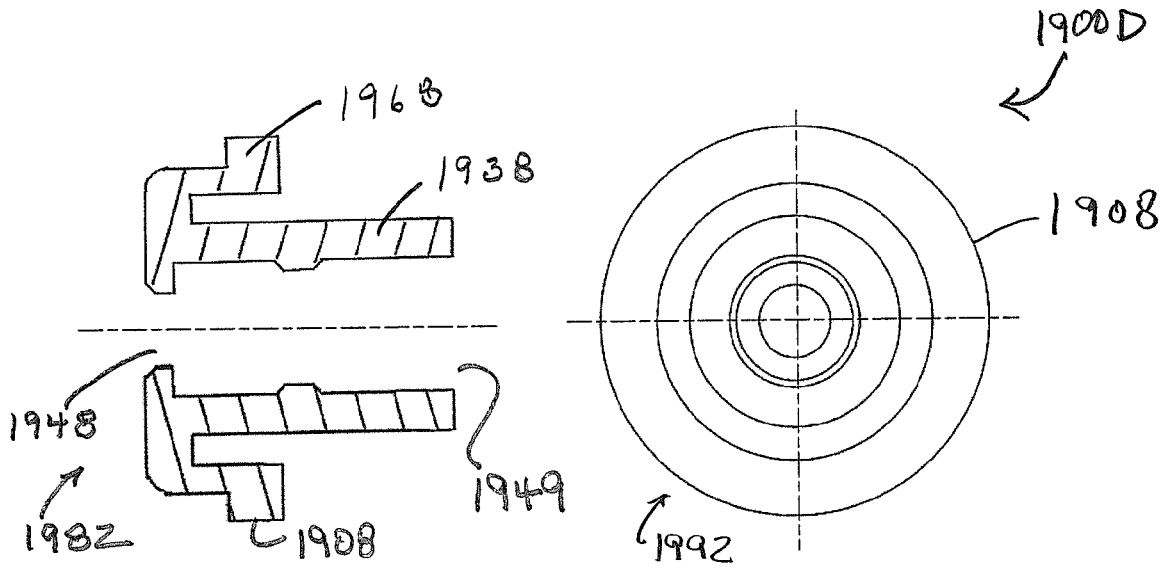

FIG. 19D shows cross sectional 1982 and end 1992 views of the second insulator 1908. The second insulator includes a central tubular section 1938 with a mouth 1948 adjacent to the waveguide aperture 1946 and a rear entry 1949 for receiving the connector center pin 1910. In various embodiments, a coaxially arranged collar 1968 encircles and is attached to the tubular section.

Figure 19E:
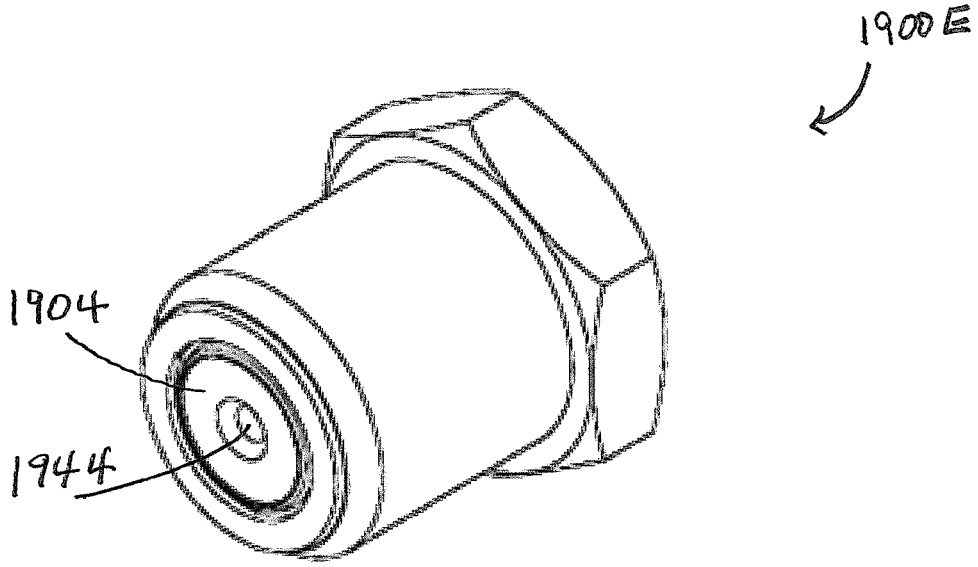

FIG. 19E shows a perspective view of a female coaxial connector port fitted with the third insulated aperture waveguide of FIGS. 1900B-C. In various embodiments, a through hole 1944 of the insulator 1904 provides access via the waveguide aperture 1946 and second insulator mouth 1948 to the connector center pin 1910.

Figure 20A:
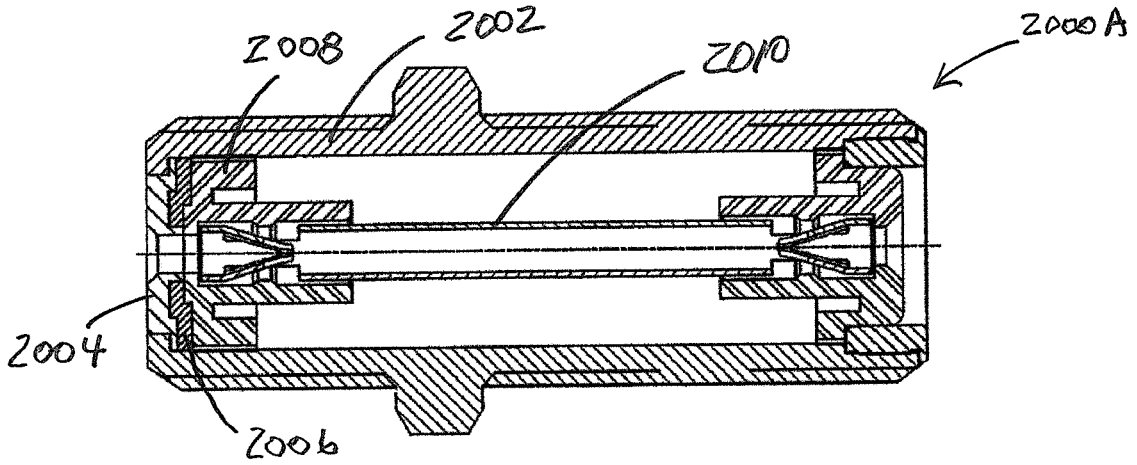
FIGS. 20A-D show a fourth insulated aperture waveguide.

FIGS. 20A-D show a splice having a fourth insulated aperture waveguide 2000A-D. As seen in FIG. 20A, the insulated aperture waveguide includes a waveguide 2006 and a first or inside mount insulator 2004. The waveguide is located between the first insulator and a second insulator 2008 that supports a center pin 2010 within the body 2002 of the connector.

Figure 20B:
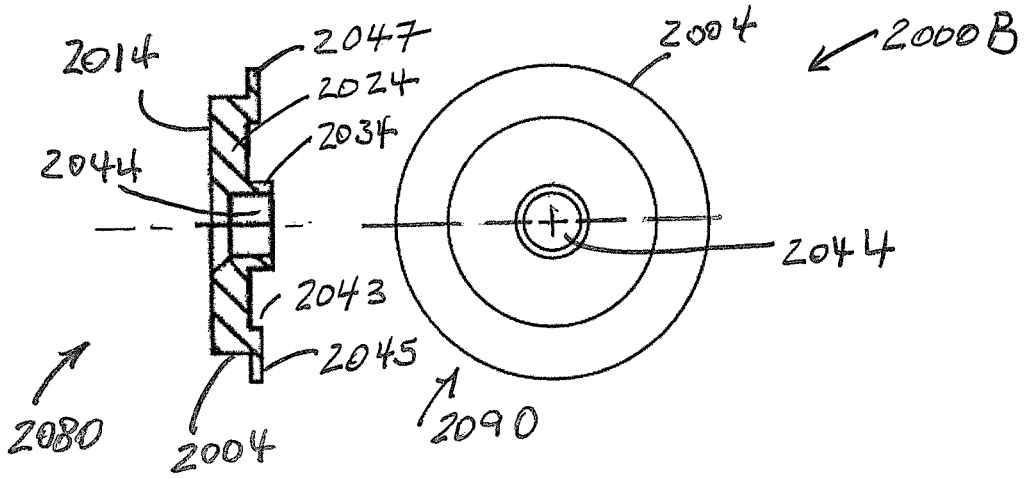

FIG. 20B shows cross sectional 2080 and end 2090 views of the inside mount insulator 2004. An insulator flange 2014 has inner 2024 and outer 2047 flange portions and the inner flange portion adjoins a coaxially arranged insulator neck 2034. The insulator neck 2034 is for insertion in a waveguide aperture 2046.

An insulator through hole 2044 is for receiving a center conductor (see e.g. 1702 of FIG. 17A) while the insulator flange inner portion 2024 guards against center conductor contact with a waveguide front face 2016 (see also FIG. 20C) and the insulator neck guards against center conductor contact with a waveguide aperture wall 2036.

Figure 20C:
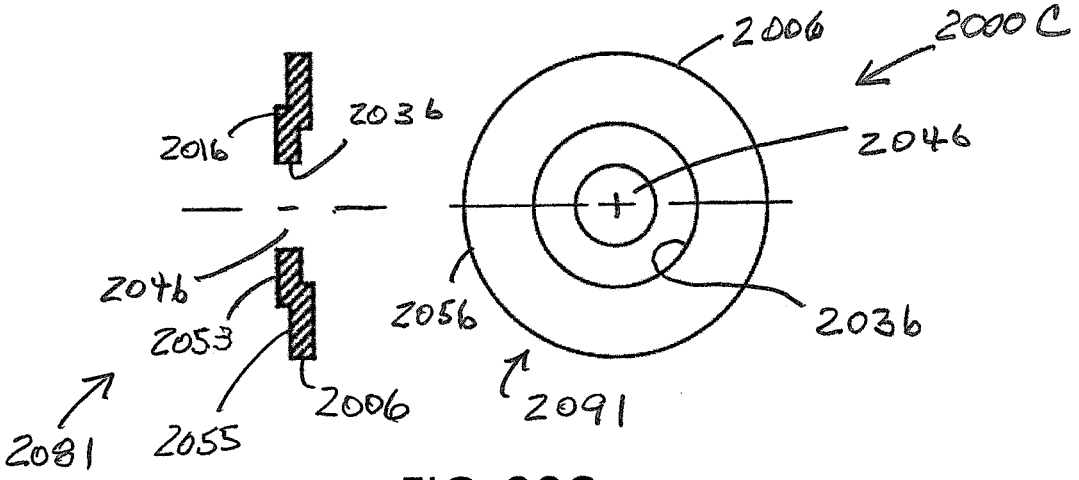

FIG. 20C shows cross sectional 2081 and end 2091 views of the waveguide 2000C. The waveguide 2006 may be formed as a disk like structure that extends radially or somewhat radially between a central aperture 2046 and an outer perimeter 2056. In the embodiment shown, the waveguide is in the form of coaxially arranged inner 2053 and outer 2055 rings, the inner ring for mating with an opposed insulator cavity 2043 and the outer ring for mating with an opposed insulator face 2045.

Figure 20D:
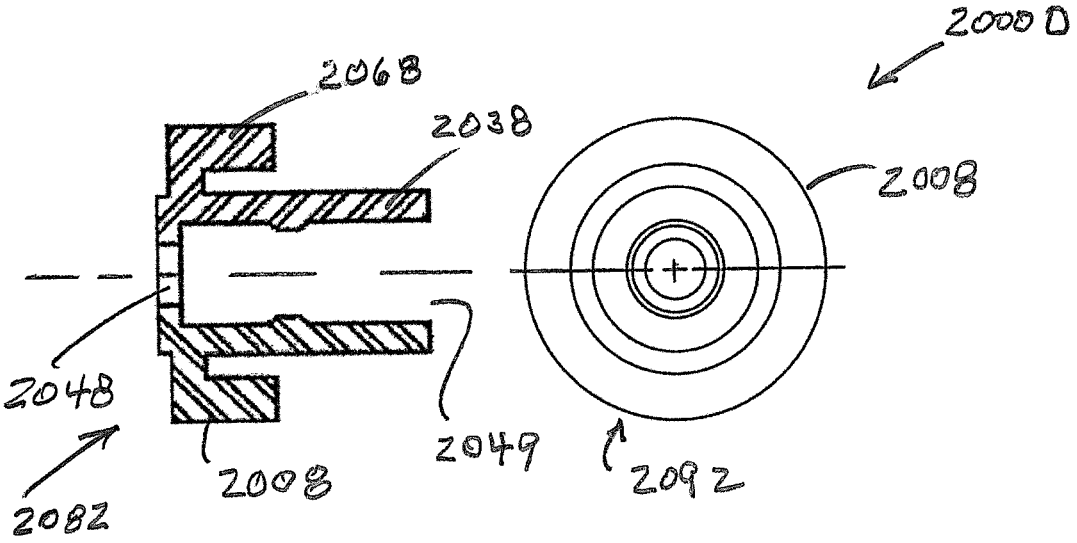

FIG. 20D shows cross sectional 2082 and end 2092 views of the second insulator 2008. The second insulator includes a central tubular section 2038 with a mouth 2048 adjacent to the waveguide aperture 2046 and a rear entry 2049 for receiving the connector center pin 2010. In various embodiments, a coaxially arranged collar 2068 encircles and is attached to the tubular section.

Figure 21A:
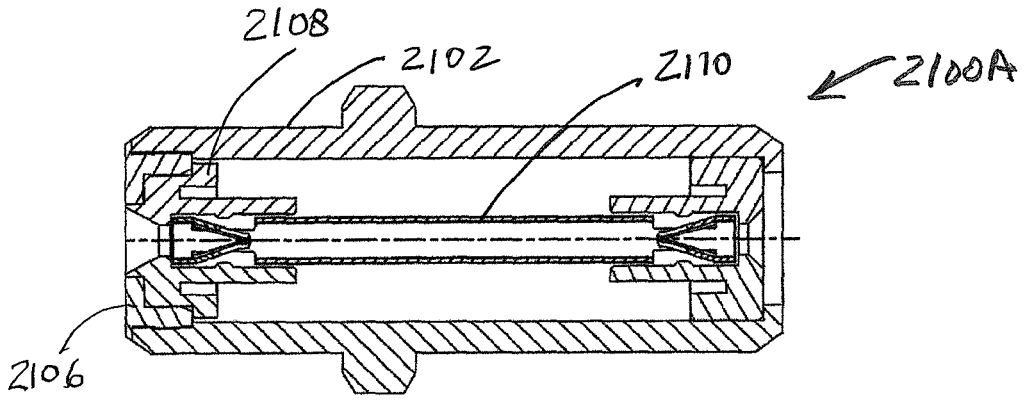
FIGS. 21A-C show a fifth insulated aperture waveguide.
Figure 21B:
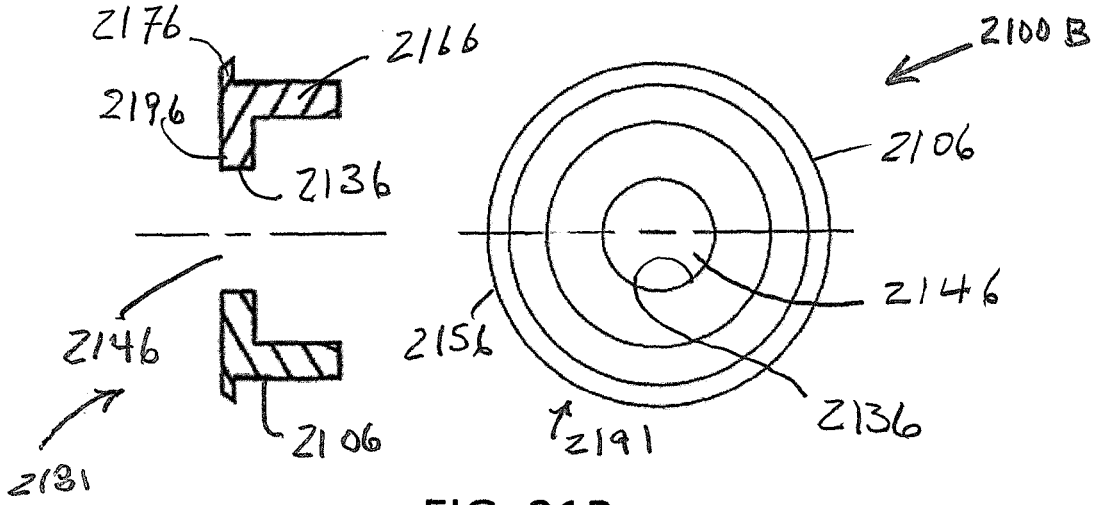
Figure 21C:
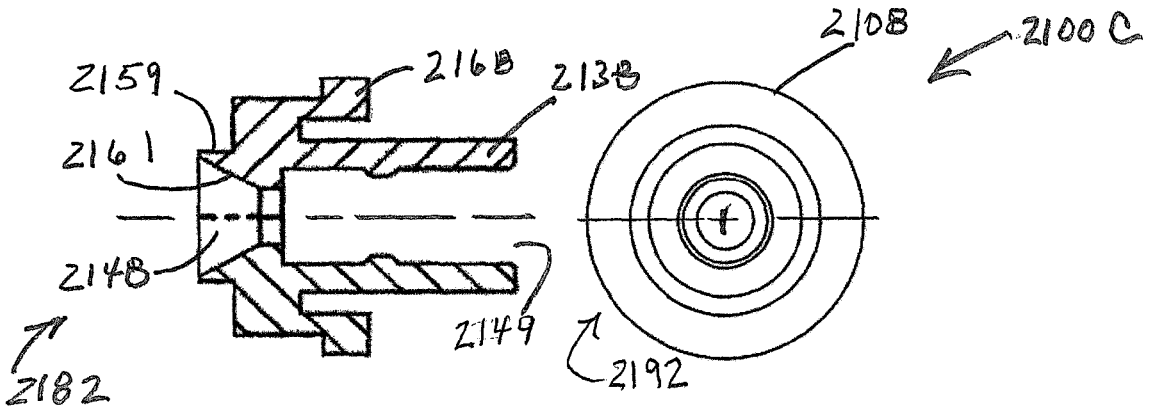

FIGS. 21A-C show a splice having a fifth insulated aperture waveguide 2100A-C. As seen in FIG. 21A, the insulated aperture waveguide includes an outside mount waveguide 2106 and an inside mount insulator 2108 that supports a center pin 2110 within the body 2102 of the connector.

FIG. 21B shows cross sectional 2181 and end 2191 views of the waveguide 2100B. The waveguide may be formed as a disk like structure that extends radially or somewhat radially between a central aperture 2146 and an outer perimeter 2156. As shown, the waveguide includes an outer cylindrical portion 2166 and a inwardly directed rim 2196 defining an aperture wall 2136. In various embodiments, peripheral waveguide shoulder 2176 is for seating against the connector body 2102.

FIG. 21C shows cross sectional 2182 and end 2192 views of the insulator 2108. The insulator includes a central tube like section 2138 and in some embodiments, a coaxially arranged collar 2168 that encircles and is attached to the tubular section.

A central tube section mouth 2148 is for receiving a center conductor such as the center conductor of a coaxial cable and a rear entry 2149 for receiving a connector pin 2110. In various embodiments, the mouth is designed with a projecting portion 2159 for insertion into and/or through the waveguide aperture 2146 (see FIG. 21A,B). As seen, the mouth projecting portion guards against center conductor contact with the waveguide aperture wall 2136. Some embodiments include an internal mouth chamfer 2161 for guiding the center conductor into and/or through the mouth.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. An unswitched F-type connector with ingress reduction shielding and without moving parts, the connector comprising:

an outer connector body and a coaxially arranged center pin that extends from one end of the body to an opposed end of the body;

a connector female end for engaging a male coaxial cable connector;

a waveguide located in the female connector end, the waveguide in the form of a metallic disc with a central aperture; and, the waveguide aperture insulated by a first electrical insulator having a through hole for receiving a center conductor of a coaxial cable;

wherein the waveguide central aperture has a diameter in the range 2.0 mm to 3.0 mm, the insulator has a radial thickness that provides a nominal radial clearance between the center conductor and the insulator of at least 0.19 mm, and the waveguide is configured to shield connector body internals from ingress of radio frequency signals in the range of 10 to 100 megahertz.

2. The connector of claim 1 wherein the insulator through hole has a chamfer for receiving the center conductor.

3. The connector of claim 1 further comprising:

a waveguide web bordering the aperture and an aperture centerline about perpendicular to the waveguide web;

the thickness of a waveguide web measured along a line parallel to the aperture centerline is not less than 0.5 mm; and, the thickness of the waveguide web measured along a line parallel to the aperture centerline is not more than 1.5 mm.

4. The connector of claim 3 wherein the diameter of the aperture and the thickness of the waveguide are selected in a manner consistent with use in a 75 ohm connection.

5. The connector of claim 4 further comprising:

a second insulator supporting the center pin;

the first insulator including a flange adjoining a neck;

the flange substantially covers a center conductor entry end of the waveguide;

the neck substantially covers a cylindrical waveguide wall bounding the aperture; and, the second insulator adjacent to the end of the waveguide opposite the center conductor entry end.

6. The connector of claim 5 wherein the web adjoins a cylinder that receives the first insulator flange at one end and receives the second insulator at an opposite end.

7. The connector of claim 4 wherein the first insulator has first and second ends, the first end receives the center pin and the second end is received by the waveguide aperture.

8. The connector of claim 7 wherein the second end is internally chamfered for receiving the center conductor.

9. A method of shielding a coaxial connector female connection when the connection is not in use and protecting against shorting when the connection is in use, the method comprising the steps of:

providing a coaxial cable connector without moving parts;

locating an insulated aperture waveguide at a female connection end of the connector; and, configuring a waveguide web bordering the aperture with a thickness in the range of 0.5 to 1.5 mm;

wherein the waveguide has a central aperture with a diameter of 2.0 to 3.0 mm and a radial clearance between a center conductor for insertion in the connector and the insulated aperture is at least 0.18 mm.

* * * * *